US005597277A

United States Patent [19]

Mayfield

[11] Patent Number: 5,597,277

[45] Date of Patent: Jan. 28, 1997

[54] PERSONAL FLOTATION/TRANSPORTATION DEVICE

[76] Inventor: Daniel R. Mayfield, P.O. Box 114, Moxee, Wash. 98936

[21] Appl. No.: 366,688

[22] Filed: Dec. 30, 1994

[51] Int. Cl.[6] ..... B63C 9/08

[52] U.S. Cl. ..... 441/130; 114/344; 114/363

[58] Field of Search ..... 114/343, 344, 114/346, 351, 352, 353, 354, 357, 361, 363, 364; 441/129, 130–132, 35

[56] References Cited

U.S. PATENT DOCUMENTS

| | | | |
|---|---|---|---|
| D. 258,055 | 1/1981 | Moody | D12/62 |
| D. 295,209 | 4/1988 | Reed | D21/237 |
| D. 309,937 | 8/1990 | Baxter | D22/134 |
| D. 341,866 | 11/1993 | Ross | D21/237 |
| 2,659,464 | 11/1953 | Sweetman | 114/353 |
| 3,193,852 | 7/1965 | Murrmann | 114/351 |
| 3,471,875 | 10/1969 | Lyon | 9/2 |
| 3,822,427 | 7/1974 | Ewart | 114/352 |
| 4,638,593 | 1/1987 | Garcia | 43/54.1 |
| 4,730,569 | 3/1988 | Colson | 114/43 |
| 4,926,781 | 5/1990 | Bauer | 114/351 |
| 5,058,522 | 10/1991 | Bauer | 114/351 |
| 5,123,371 | 6/1992 | Giordano et al. | 114/364 |
| 5,163,694 | 11/1992 | Reichek | 280/47.26 |
| 5,171,178 | 12/1992 | Creek et al. | 441/132 |
| 5,217,400 | 6/1993 | Creek et al. | 441/132 |
| 5,239,940 | 8/1993 | Griffin | 114/353 |

OTHER PUBLICATIONS

Datus C. Proper; Fin Power;Field & Stream Aug. 1992 pp. 60–61; 91–92.

Joel Vance; Humor; North American Fisherman; p. 94.

Cabela's Spring 1994 Catalog; p. 127.

Peter Barrett; The Power of the Tube; Field & Stream Jul. 1990; pp. 66–69.

A Boat You Can Wear; Field & Stream May 1992; p. 54.

*Primary Examiner*—Stephen Avila

*Attorney, Agent, or Firm*—Stratton Ballew PLLC

[57] ABSTRACT

A sportsman's flotation device is disclosed, having a hull including a bow, stern and a full keel, a seat disposed within the keel and an opening defined in the device for receiving the sportsman's legs therethrough for propelling and directing the device. The device may include a buoyancy activated barrier for opening an closing an exit, interchangeable stern adapters for modifying the shape or configuration of the device and detachable wheel and handles for transporting the device. Also included are a plurality of attachment points on the hull for receiving a variety of attachments associated with hunting, fishing and outdoor recreation, including a car top carrier.

14 Claims, 41 Drawing Sheets

PERSONAL FLOTATION/TRANSPORTATION DEVICE

TECHNICAL FIELD

This invention relates to personal flotation devices used in activities such as hunting and fishing. More specifically, the invention relates to a flotation device in the shape of a boat which has many of the hydrodynamic advantages of a conventional boat. The device disclosed herein is propelled through the water by kicking.

BACKGROUND OF THE INVENTION

In the sports of fishing and waterfowl hunting, a need has long existed for a means of moving the sportsman and his gear across the water. Boats, canoes, rafts, and float tubes have all been used with varying degrees of success, but none fully meets the need of a sportsman.

A need exists for a personal flotation/transportation device which can be rapidly propelled through the water by the kicking action of the legs of the user. Kick-powered flotation devices currently available are not designed for rapid movement, or for movement over a significant distance. There are also available on the market small, powered water craft which will transport the user across greater distances, and at greater speed than a kick powered boat. However, there are many fishing and hunting sites at which the use of a motor is either impractical or prohibited.

A need further exists for a personal flotation/transportation device which is stable in the water, and unlikely to capsize. The float tubes currently available are filled with air, and will deflate and lose buoyancy if punctured, presenting a significant risk to the user and his gear. Even when fully and properly inflated, the float tube design is prone to overturning. A sportsman using a flotation device needs to be able to move about, cast a fishing line, bait hooks, clean fish, fire a shotgun, access gear and refreshments, and perform other activities relating to his sport, without the risk of overturning or puncturing his flotation device. Additionally, float tubes have traditionally been difficult to steer. Tracking is particularly difficult in high winds or in cross wind situations. The inability to track presents a great danger to the sportsmen, who may not be able to make it back to her camp or vehicle before nightfall or bad weather approaches.

Because many sportsmen hunt or fish alone, it would be advantageous to have a personal flotation/transportation device which can be transported by one person, without any assistance from additional persons. It would further be advantageous to have a personal flotation/transportation device which does not require inflation or other preparation prior to use.

The sports of fishing and hunting require the use of multiple accessories such as rods, reels, tackle, bait, shotguns and ammunition. In addition, because the sportsman often spends several hours on the water, he may also wish to have access to refreshments. It would therefore be advantageous to have easily accesible storage compartments, suitable for various uses, built in to a personal flotation/transportation device.

A need also exists for a personal flotation/transportation device which has optional accessories such as a weather shade, duck blind, or lighting system.

SUMMARY OF THE INVENTION

The invention comprises a sportsman's flotation device is disclosed, having a hull including a bow, stern and a full keel, a seat disposed within the keel and an opening defined in the device for receiving the sportsman's legs therethrough for propelling and directing the device. The device may include a bouayancy activated barrier for opening an closing an exit, interchangable stern adapters for modifying the shape or configuration of the device and deatchable wheel and handles for transporting the device. Also included are a plurality of attachment points on the hull for receiving a variety of attachments associated with hunting, fishing and outdoor recreation.

It is an object of the present invention to provide a personal flotation/transportation device which can be rapidly propelled through the water by the kicking action of the legs of the user, without the need for a motor or other propulsion means.

It is a further object of the present invention to provide a personal flotation/transportation device which is resistant to puncture and other damage.

It is an additional object of the present invention to provide a personal flotation/transportation device which is stable and resistant to overturning.

It is yet an additional object of the present invention to provide a personal flotation/transportation device which can be transported easily when not in use.

It is a further object of the present invention to provide a personal flotation/transportation device which provides secure, convenient storage space for gear and supplies.

Finally, it is an object of the present invention to provide a personal flotation/transportation device which can receive attachments for providing shade, camoflauge, light, and other needed functions.

These and other objectives will become clear in the description which follows.

BEST MODE OF CARRYING OUT THE INVENTION

Figure 1A:
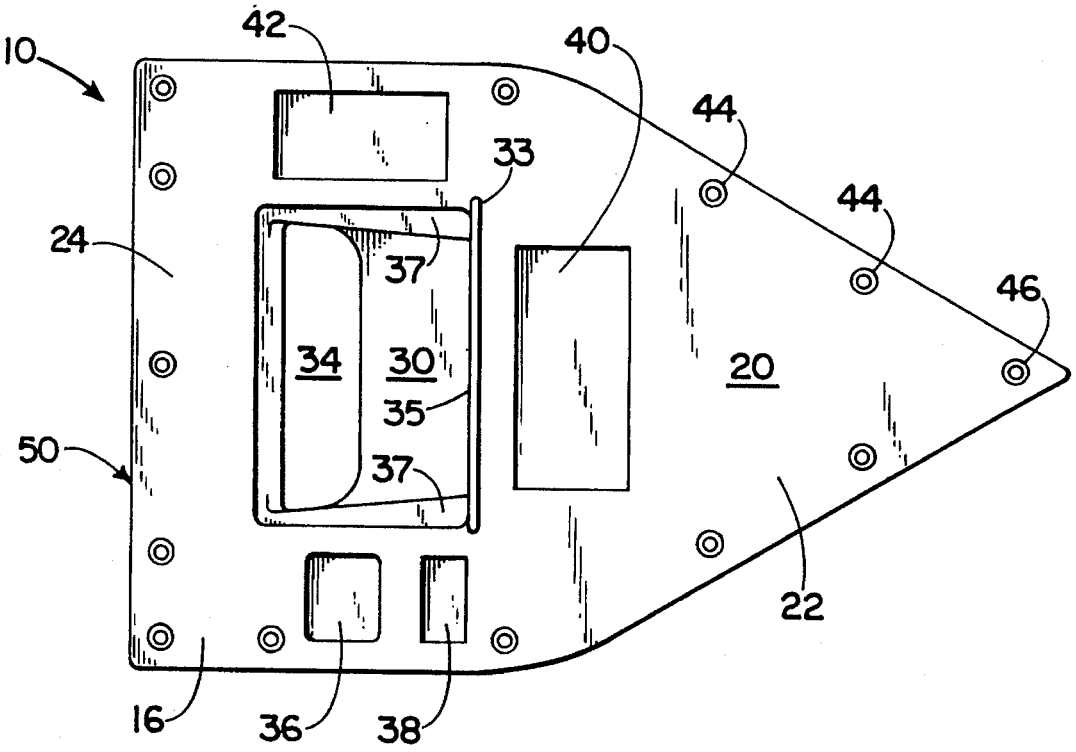
FIG. 1A is a top plan view of the first preferred embodiment of the invention

As shown in FIGS. 1A, 1B, 1C, 1D, 1E, 1F, and 2, the first perferred embodiment comprises a flotation device 10 with a bow 22 and a stern 24, having a hull 16 with a substantially horizontal upper surface 20, a curved lower surface 80, and a full keel shown generally as 60.

Rather than use a daggerboard, centerboard or a fin keel, the floatation device 10 is designed with a full keel 60. The keel 60 has a curved side surface 62 adjacent lower surface 80, and a substantially horizontal bottom surface 64. A cavity is formed between the curved side surface 62, which provides space in which the user may be seated. The use of a full keel 60 provides two benefits: 1) the keel aids tracking, especially when a crosswind is encountered; and 2) the user, seated in the keel 60 acts as ballast, adding stability to the craft's design. While a full keel 60 is known, to date it has been associated only with large sailboats, to provide lateral resistance against the force created by wind in the sails. The ballast traditionally associated with a full keel 60 is metal, such as lead or stone. Since a keel 60 of any type tends to reduce the draft, prior art has suggested that keels 60 be left out of small craft such as canoes, kyacks, row boats, dinghys, and float tubes.

Figure 1B:
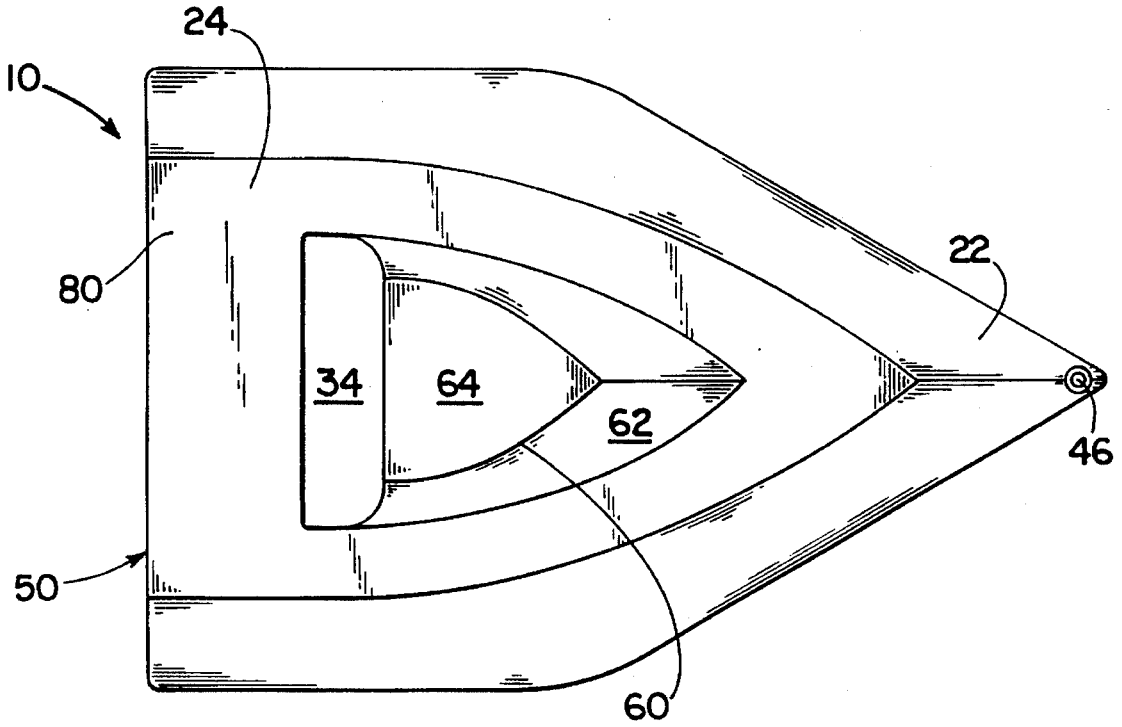
FIG. 1B is a bottom plan view of the first preferred embodiment of the invention.
Figure 1C:
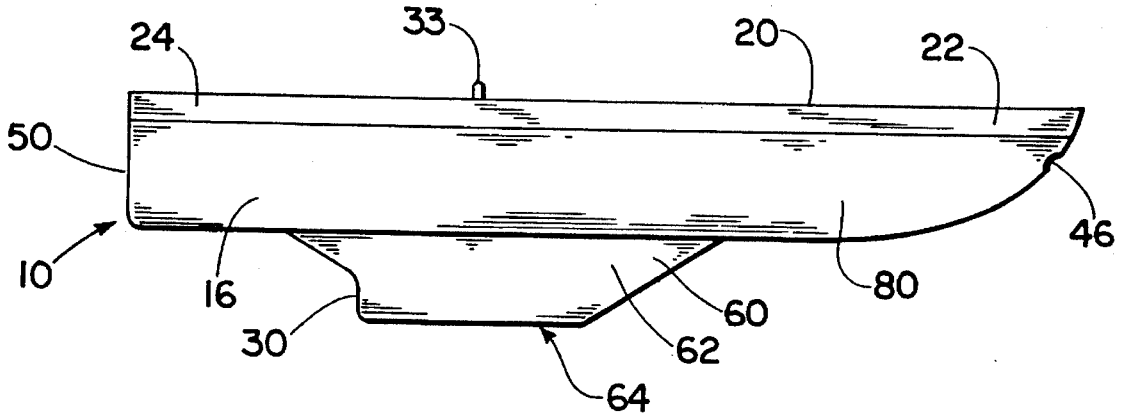
FIG. 1C is a side plan view of the first preferred embodiment of the invention.

With specific reference to FIGS. 1A and 1C, an opening 34 is defined through the hull 16. Below the upper surface 20 is a seating means for supporting the user, comprising a curved seat 30, a substantially vertical backrest 35, and side walls 37. A safety strap 132 is secured to the front edge of seat 130, and extends across opening 134 to a substantially rectangular stern 50 having a transom 54. A lip 33 protrudes substantially vertically above upper surface 20.

Four concavities 36, 38, 40, and 42 are defined in the upper surface 20 in the hull 20 for receiving containers, refreshments, accessories, and the like. While not shown in the drawings, alternative preferred embodiments may have more or less than four concavities, have concavities of different size and shape than those pictured, or have concavities placed in different locations in the hull than those shown in the drawings.

A plurality of attachment means 44 are situated about the perimeter of the upper surface 20 of hull 16. The attachment means 44 are used to secure interchangeable accessories to the flotation device 10, as shown in FIGS. 13 through 14. A threaded channel 46 substantially perpendicular to upper surface 20 extends from upper surface 20, through hull 16, opening at underside 80. The threaded channel 46 receives the transportation means shown in FIG. 10.

The bottom of the flotation device is shown in FIGS. 1B and 1C. The underside 80 curves downward from upper surface 20, forming an apex at the distal end of the bow 22.

A substantially vertically oriented transom 50 joins upper surface 20 to lower surface 80 at the distal end of the stern 24. Full keel 60 projects downward from lower surface 80. Opening 34 in hull 16 is situated between the substantially horizontal bottom surface 64 of keel 60, and the stern 24.

Figure 1D:
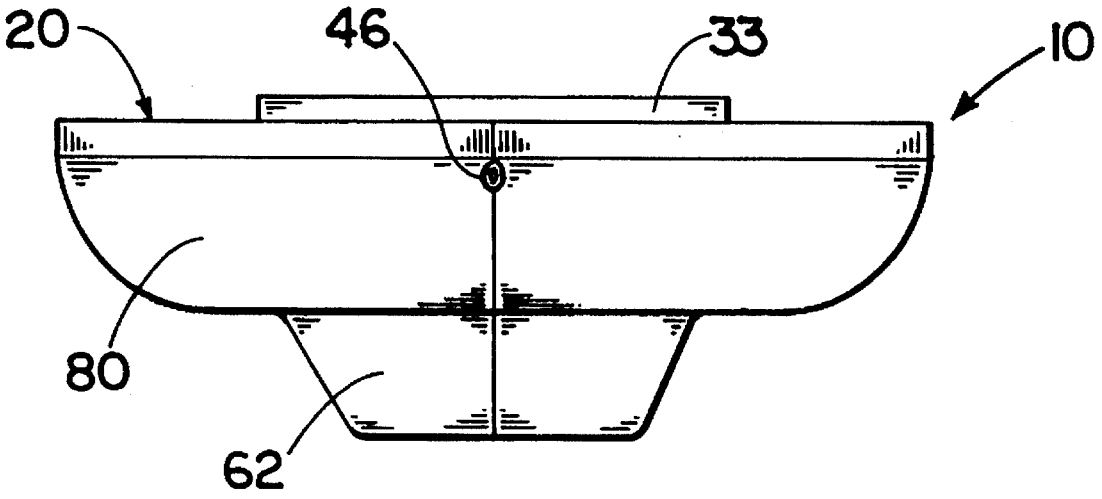
FIG. 1D is a front plan view of the first preferred embodiment of the invention.
Figure 1E:
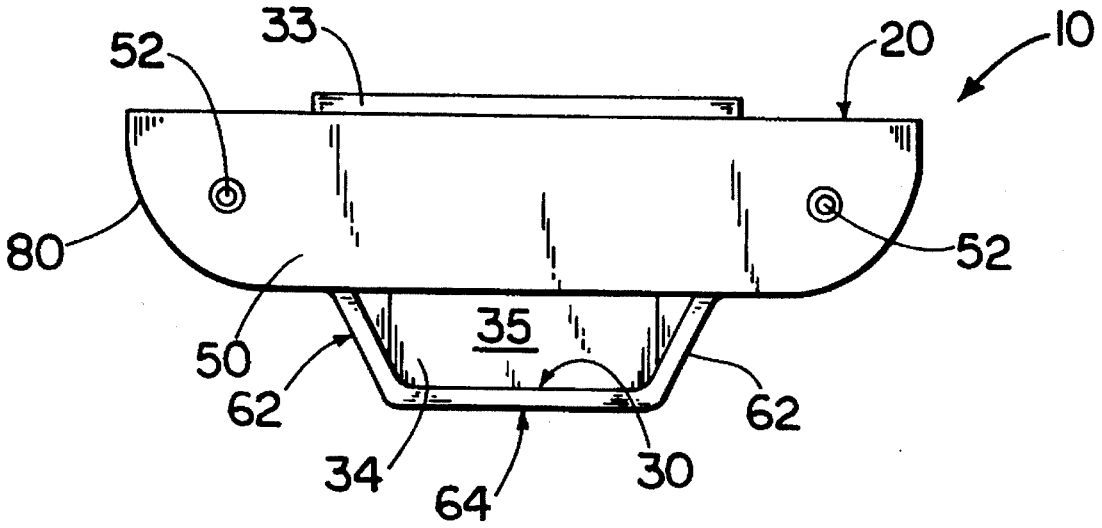
FIG. 1E is a back plan view of the first preferred embodiment of the invention.

FIG. 1D depicts the flotation device as viewed from the bow end. FIG. 1E depicts the flotation device as viewed from the stern end. Seat back 35 is shown as viewed through opening 34 in the hull 16.

Figure 1F:
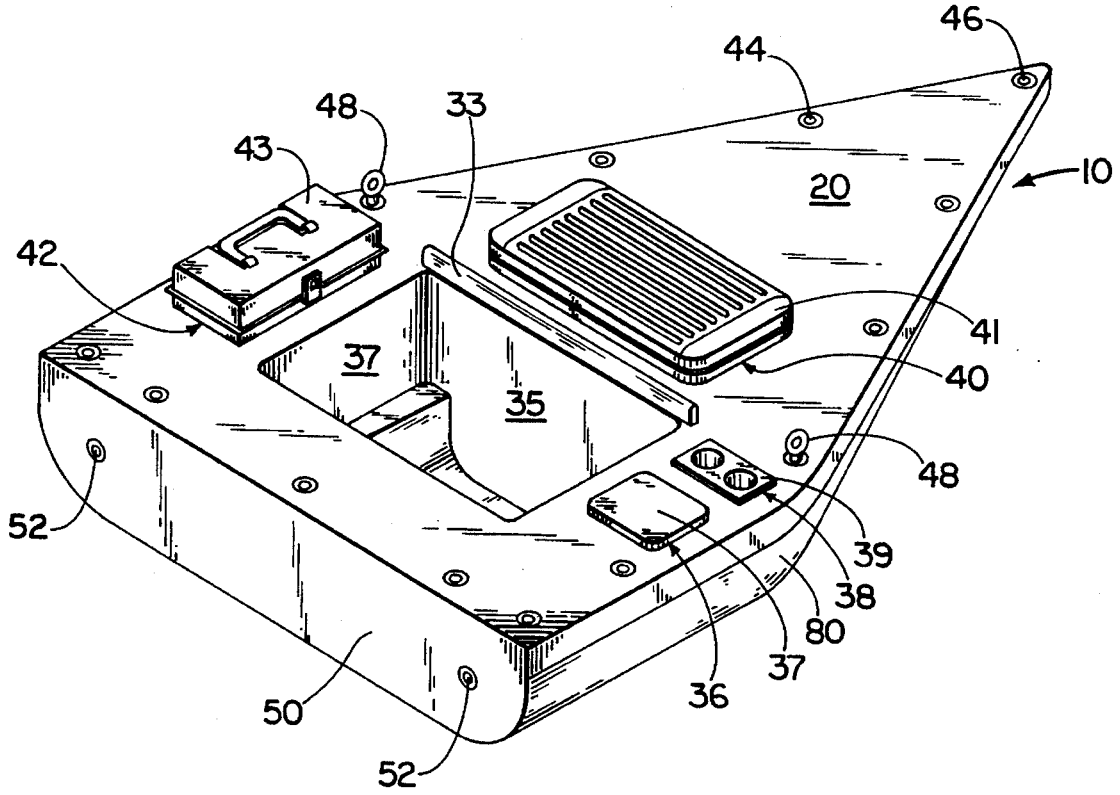
FIG. 1F is a perspective view of the first preferred embodiment of the invention with storage means.

FIG. 1F is a perspective view of the flotation device described in FIGS. 1A, 1B, 1C, 1D, and 1E. A bait box 37 is inserted in concavity 36; a drink holder 39 is inserted in concavity 38; an ice chest 41 is inserted in concavity 40; and a tackle box 43 is inserted in concavity 42.

Figure 2:
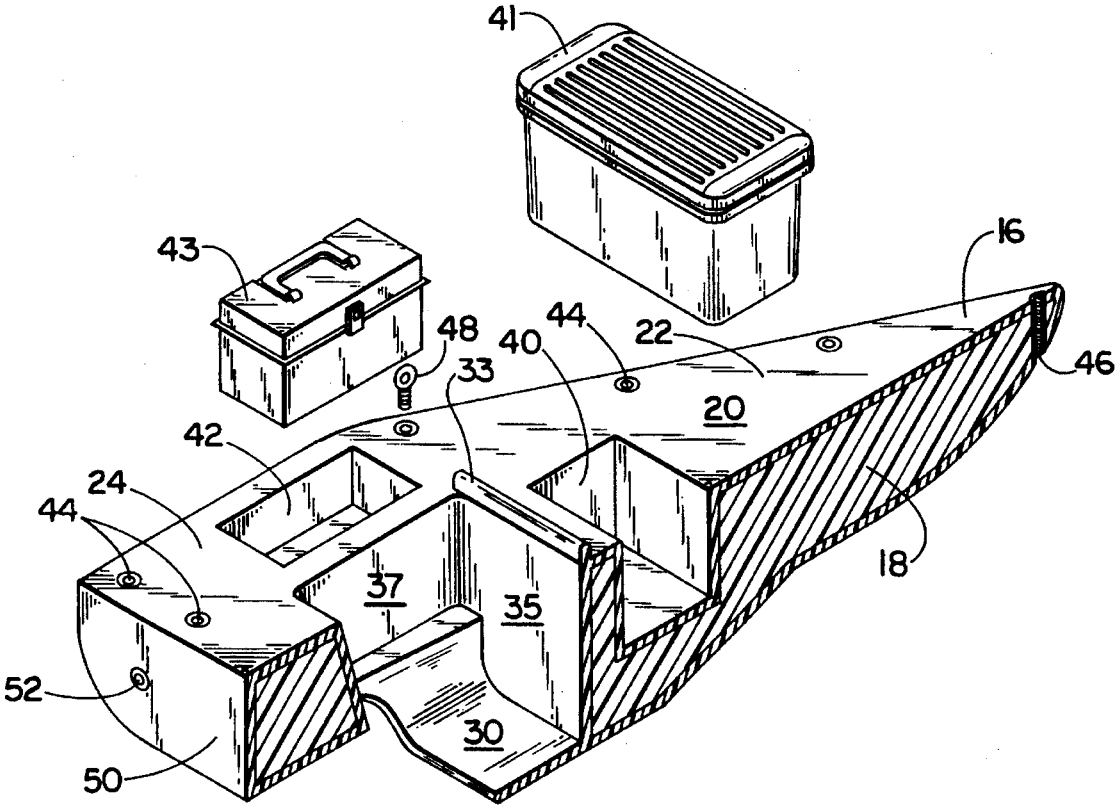
FIG. 2 is a sectional view taken along the ceterline of the first preferred embodiment of the invention.

With specific reference to the sectional view of FIG. 2, the hull 16 is filled with a buoyant material 18. Applicant has had success using an aerosol expanding foam, but other kinds of low density foam are contemplated for providing buoyancy. Alternatively, the hull may be made of a buoyant material.

FIGS. 3A, 3B, 3C, 3D, 3E, 3F, 3G and 4 show a second preferred embodiment of the invention comprising of a flotation device 110 having a hull 116 with a bow 122 and a stern 124, a substantially horizontal upper surface 120, a curved lower surface 180, a full keel shown generally as 160, an aperture 157 defined in the hull 116 preferably through the transom 154 at the stern 124, and a barrier 150. The keel has a curved side surface 162, adjacent the lower surface 180, and a substantially horizontal bottom surface 164.

In this embodiment, a buoyant barrier 150 is slidably mounted in the aperture 157 in hull 116. The aperture 157 provides a convenient way for a user to enter and exit the floatation device 110, without having to struggle over the hull 116.

Figure 4:
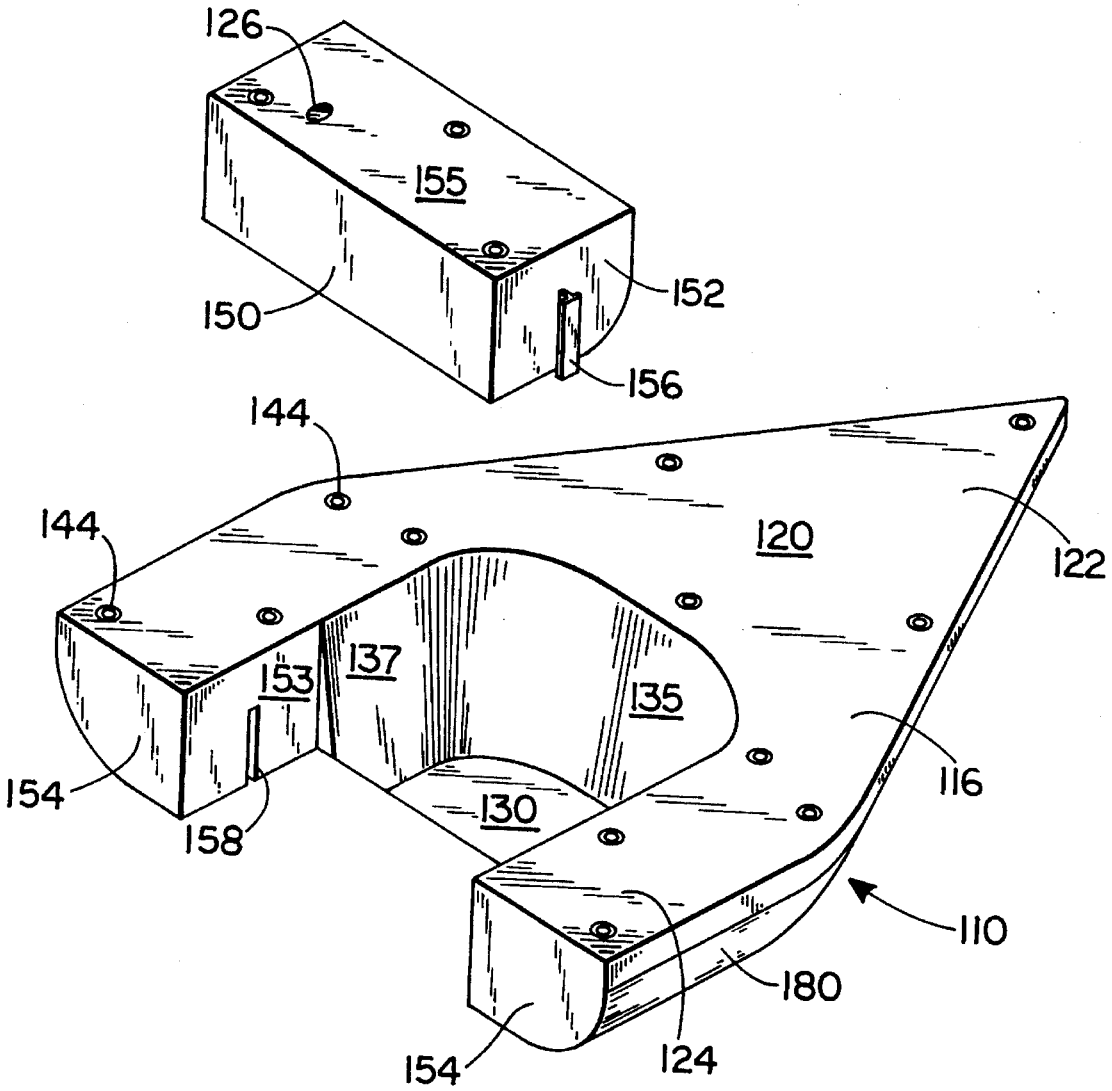
FIG. 4 is a perspective view of the second preferred embodiment of the invention, showing the retangular stern insert removed from the body.

With specific reference to FIG. 4, the barrier 150 has two ends 152 which are substantially perpendicular to its upper surface 155. The flotation device 110 slidably receives the barrier 150 into the aperture 157 by sliding the T-shaped flanges 156 located on ends 152 into the T-shaped channel 158 located on inside walls 153 of the flotation device 110. Inside walls 153 are substantially perpendicular to upper surface 120 of flotation device 110, and complementary to the angle of ends 152 of barrier 150, such that when the barrier 150 is installed in the flotation device 110, ends 152 are substantially adjacent to respective inside walls 153. Upper surface 155 of the barrier 150 is substantially horizontal.

The flotation device 110, like all waterborne craft has a pair of waterlines. The unloaded waterline 171 is the line about the hull 116 that would be level with the surface of the water when the flotation device 110 sits in the water unloaded. The loaded waterline 171 is the line about the hull 116 that would be level with the surface of the water when the flotation device 110 sits in the water loaded. The loaded waterline 171 is of course dependent on the weight of the load, however for our purposes we assume the load to be the weight of the average user, 160 lbs. The loaded waterline 171 is spaced relatively above the unloaded waterline 171.

Since the barrier 150 is slidably mounted in the aperture 157, it is free to establish its own level of equilibrium in the water, thereby defining its own waterline 172, only constrained by the distance the barrier 150 is permitted to slide relative to the flotation device 110. In the preferred embodiment, the barrier 150 is permitted to slide such that its waterline 172 is always level with the surface of the water.

When the flotation device 110 is loaded, its loaded waterline 171 will be level with the surface of the water. Since the barrier's waterline 172 is always level with the surface of the water, the barrier's waterline 172 and the flotation device's loaded water line 171 will be level with one another when the flotation device 110 is loaded. The dimensions of the barrier 150 may be set, such that the upper surface of the barrier 155 is even with the upper surface of the flotation device 120 at the stern 124.

When the flotation device 110 is unloaded, its unloaded waterline 170 will be level with the surface of the water. Since the barrier's waterline 172 is always level with the surface of the water, the waterline of the barrier 172 will be level with the flotation device's unloaded waterline 170 when the flotation device 110 is unloaded.

The loading and unloading of the flotation device 110 gives the appearance of the barrier sliding open when the device 110 is unloaded, and the barrier sliding closed when the device 110 is loaded. In fact, the barrier 150 remains fixed relative to the surface of the water, while the flotation device 110 is moving relative to the surface of the water.

When the user wishes to enter the flotation device, it is unloaded, and the upper surface of the barrier 155 is spaced relatively below the top surface of the flotation device 120, providing an easy pathway in for the user. When the user sits in the flotation device 110, loading it, the upper surface of the barrier 155 becomes level with the upper surface of the flotation device 120, closing the aperture 157, to provide a protected, confined space for the user. When the user wishes to exit the flotation device 110, she simply stands up, in shallow water, thus unloading the flotation device 110. Again, the upper surface of the barrier 155 is displaced below the upper surface of the flotation device 120, opening the aperture 157 for easy exit.

A receptacle 126 is provided on the barrier 150 for receiving the handle of a fishing rod (not shown).

Figure 3A:
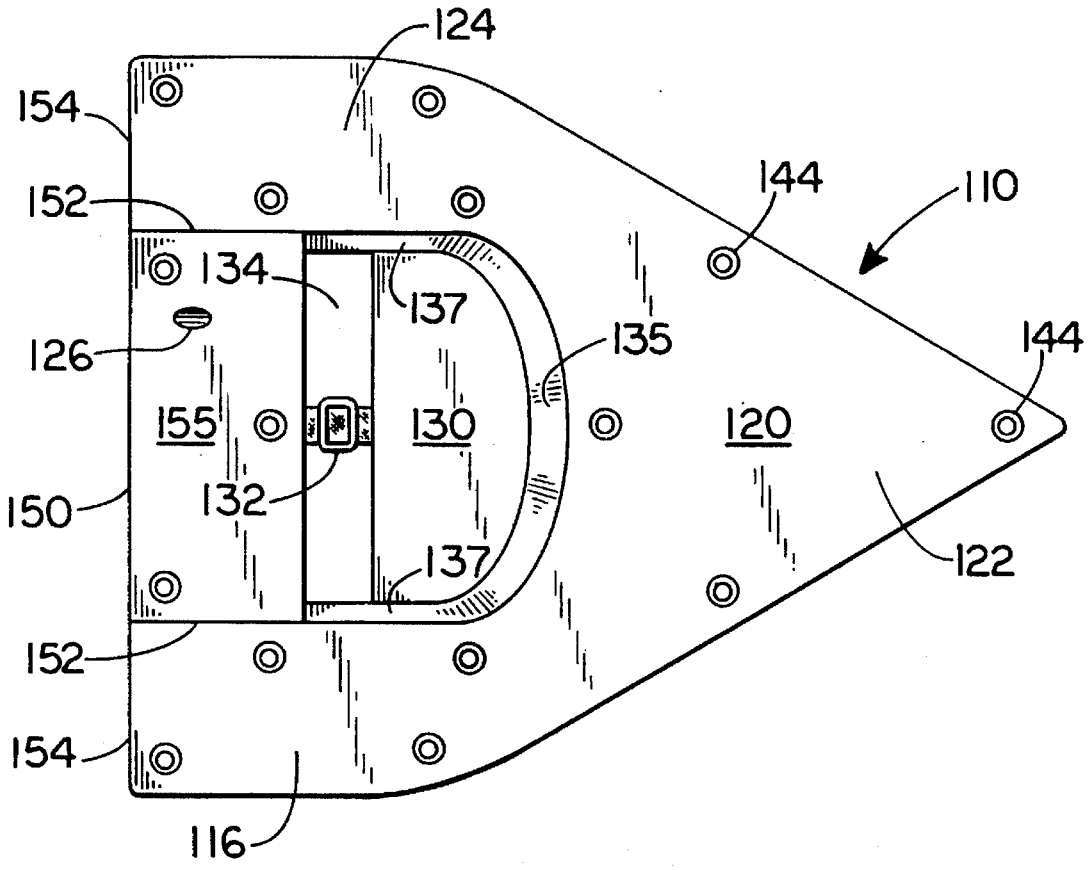
FIG. 3A is a top plan view of the second preferred embodiment of the invention, showing a removable retangular stern insert.
Figure 3B:
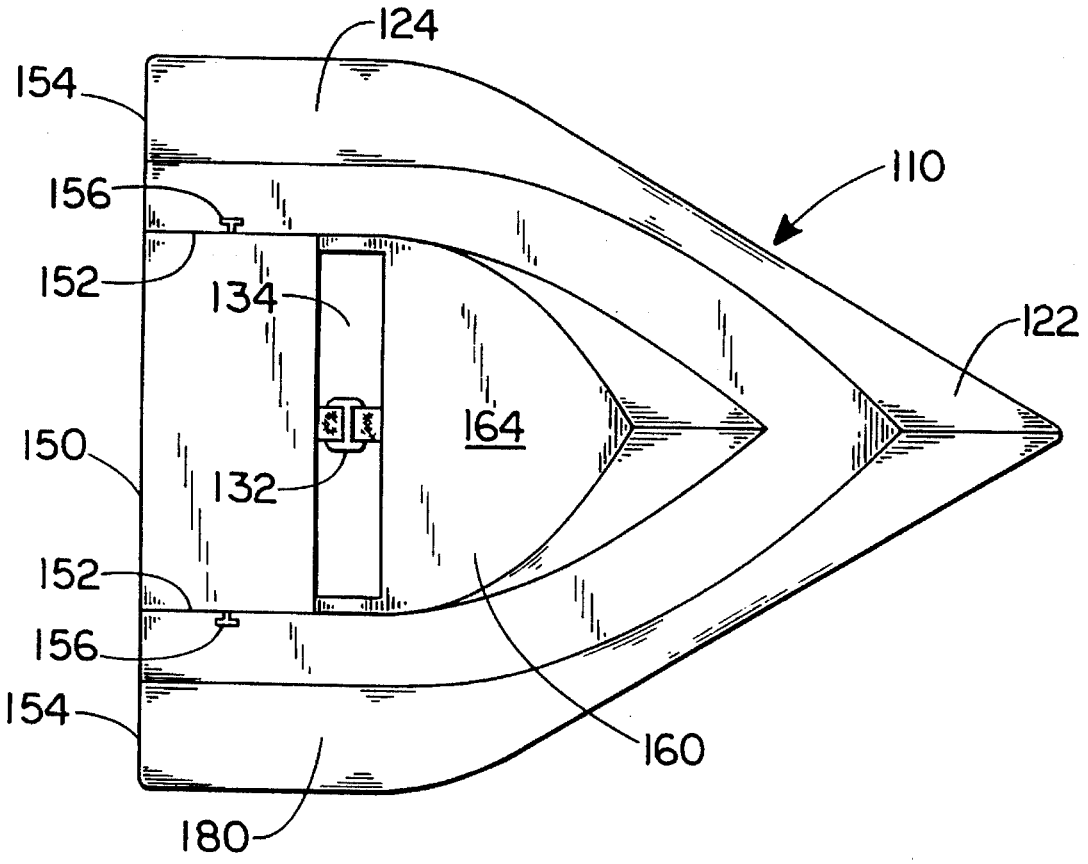
FIG. 3B is a bottom plan view of the second preferred embodiment of the invention, showing a removable retangular stern insert.
Figure 3C:
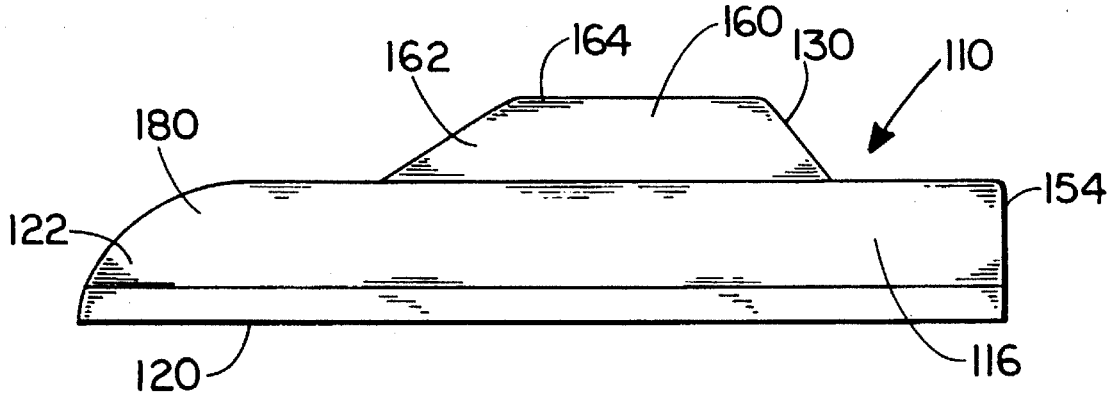
FIG. 3C is a side plan view of the second preferred embodiment of the invention, showing a removable retangular stern insert.

With reference to FIGS. 3A and 3C, an opening 134 is defined through the hull 116. Below the upper surface 120 is a seating means for supporting the user, comprising a curved seat 130, a substantially vertical backrest 135, and side walls 137.

A plurality of attachment means 144 are situated about the perimeter of the upper surface 120 of hull 116. The attachment means 144 are used to secure interchangeable accessories to the flotation device 110, as shown in FIGS. 13 through 14.

The bottom of the flotation device is shown in FIGS. 3B and 3C. The underside 180 curves downward from upper surface 120, forming an apex at the distal end of the bow 122. Full keel 160 projects downward from lower surface 180. Opening 134 in hull 116 is situated between the substantially horizontal bottom surface 164 of the keel 160, and the barrier 150.

Figure 3D:
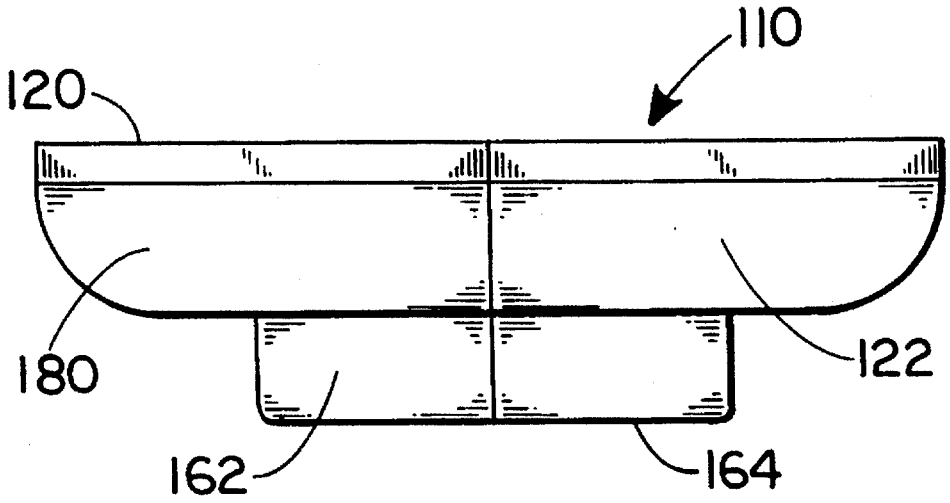
FIG. 3D is a front plan view of the second preferred embodiment of the invention, showing a removable retangular stern insert.
Figure 3E:
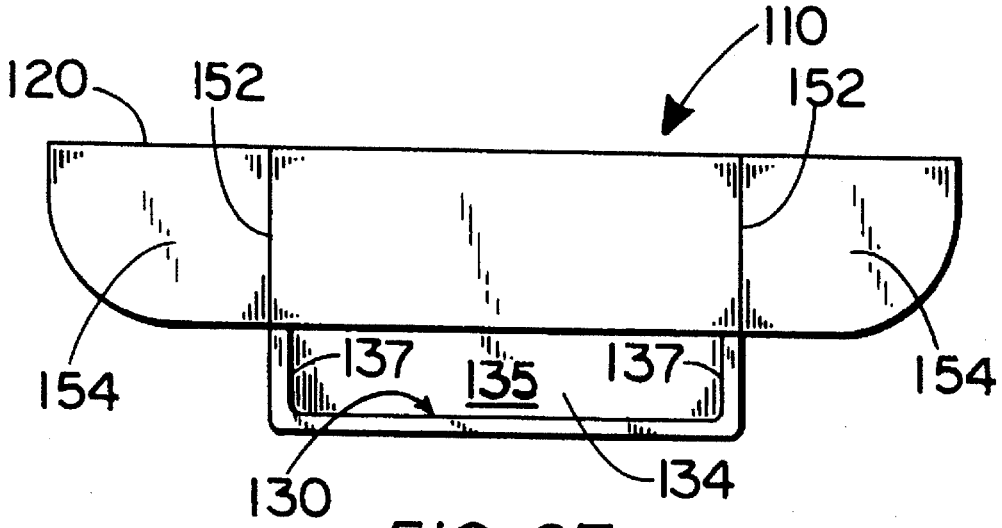
FIG. 3E is a back plan view of the second preferred embodiment of the invention.

FIG. 3D depicts the flotation device as viewed from the bow end. FIG. 3E depicts the flotation device as viewed from the stern end. Seat back 135 is shown as viewed through opening 134 in the hull 116.

Figure 3F:
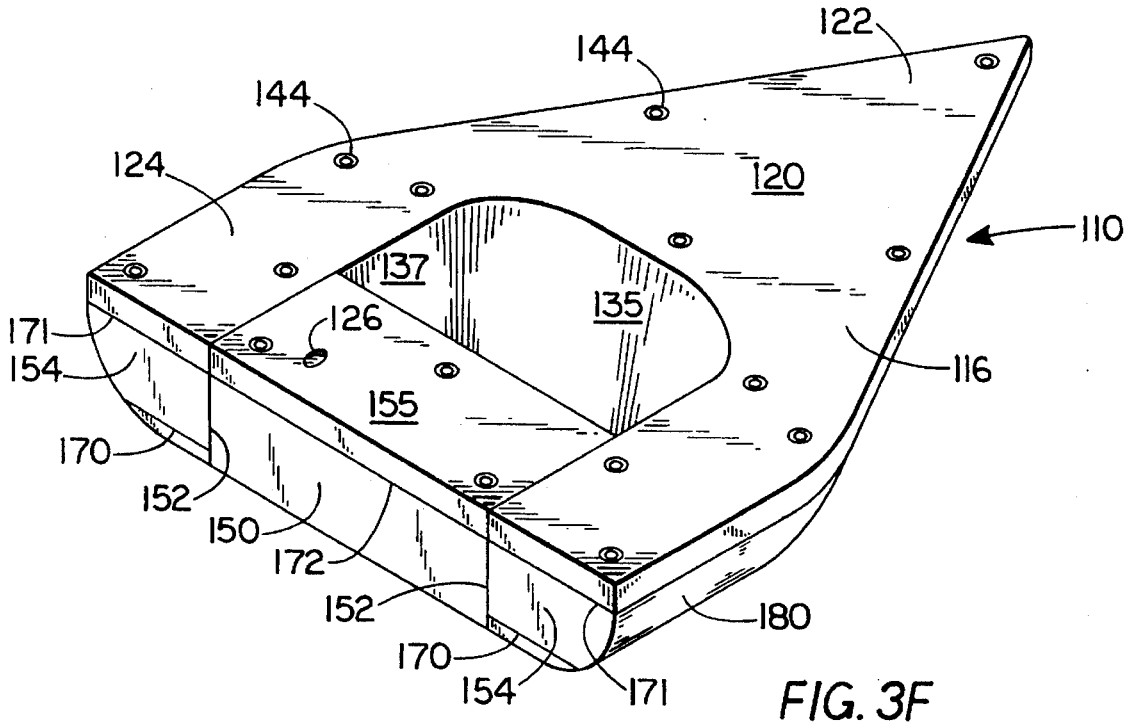
FIGS. 3F and 3G are perspective views of the second preferred embodiment of the invention, showing a removable retangular stern insert.
Figure 3G:
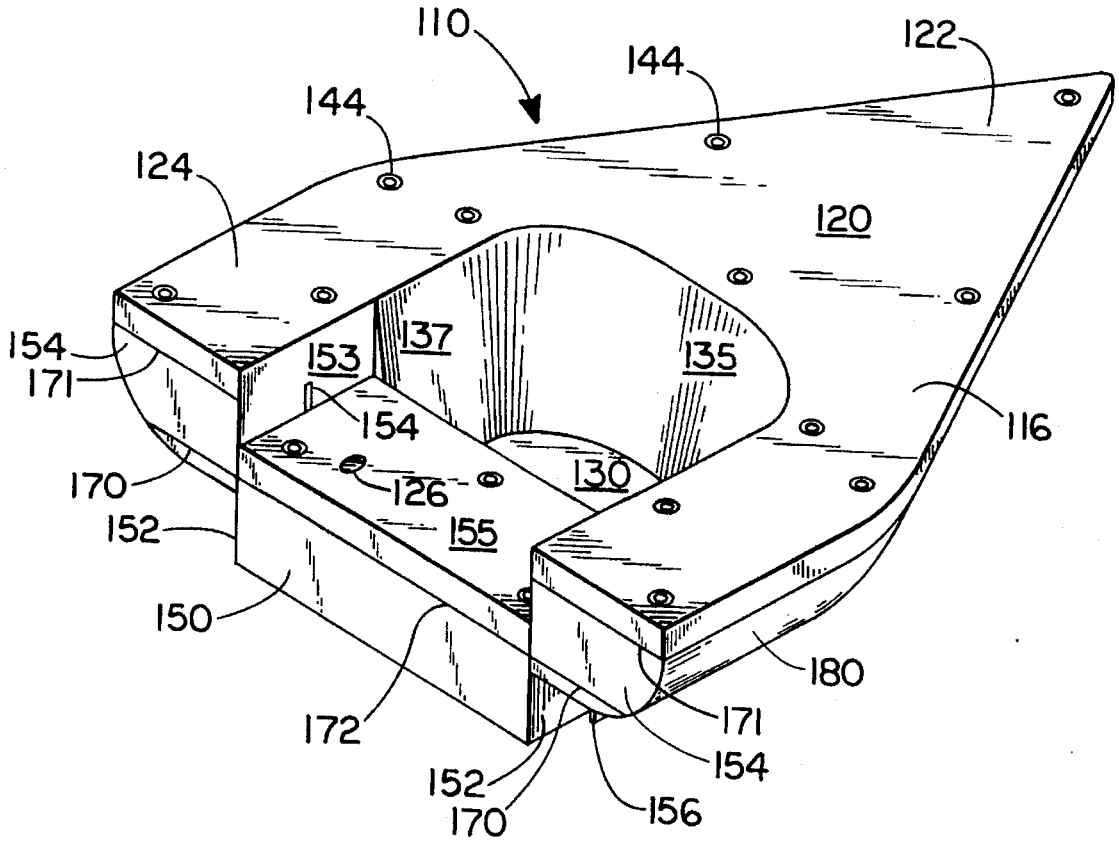

FIG. 3F is a perspective view of the flotation device described in FIGS. 3A, 3B, 3C, 3D, and 3E.

FIGS. 5A, 5B, 5C, 5D, 5E, 5F and 6 show a third preferred embodiment, comprising a flotation device 210 having a hull 216 with a bow 222 and a stern 224, a substantially horizontal upper surface 220, a curved lower surface 280, and a full keel shown generally as 260. The keel has a curved side surface 262, adjacent the lower surface 280, and a substantially horizontal bottom surface 264. In this embodiment, a substantially T-shaped stern adapter 250 is inserted in the aperture 157 in the stern 224. The stern adapter 250 may be slidingly mounted, as the barrier 150 described above, or may be fixedly mounted onto the flotation device 210.

The stern adapter 250 allows the shape and configuration of the flotation device 210 to be easily changed to suit the user, activity or body of water. Stern adapters 250 of various shapes may be provided. Additionally, various types of attachment means and concavities may may be provided on different stern adapters 250.

A receptacle 226 is provided on rectangular stern adapter 250 for receiving the handle of a fishing rod (not shown).

Figure 5A:
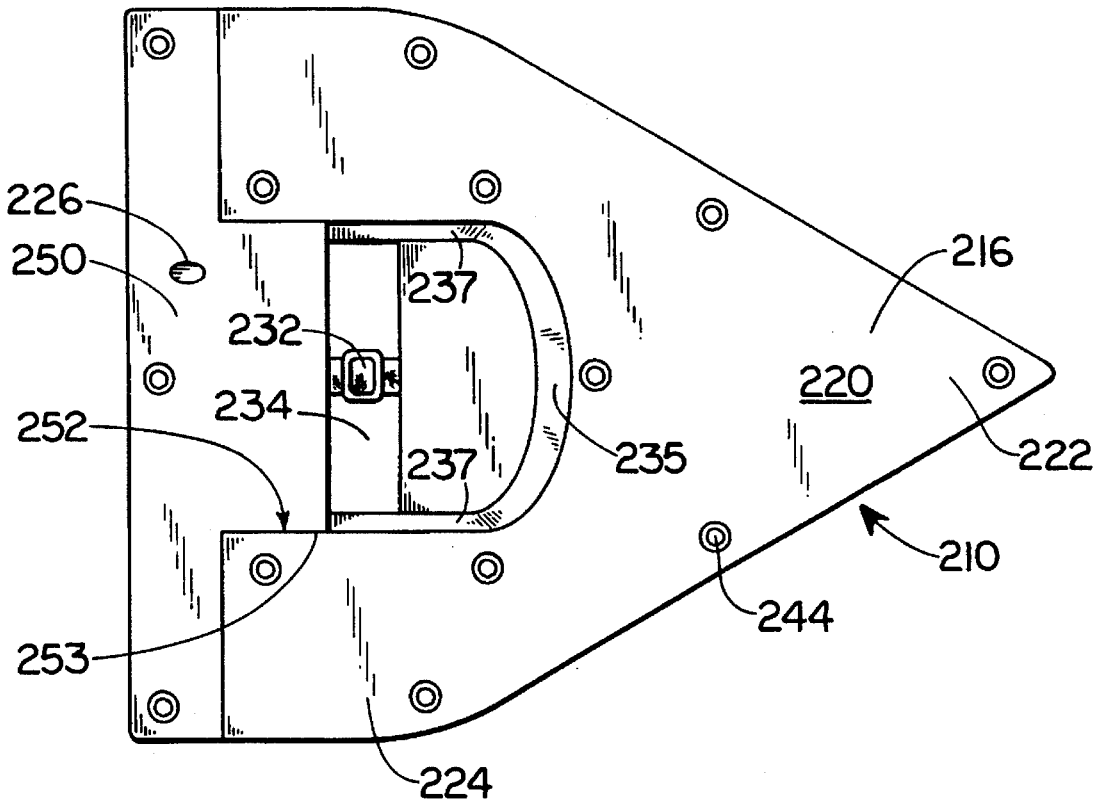
FIG. 5A is a top plan view of a third preferred embodiment of the invention, showing a removable T-shaped stern section.
Figure 5B:
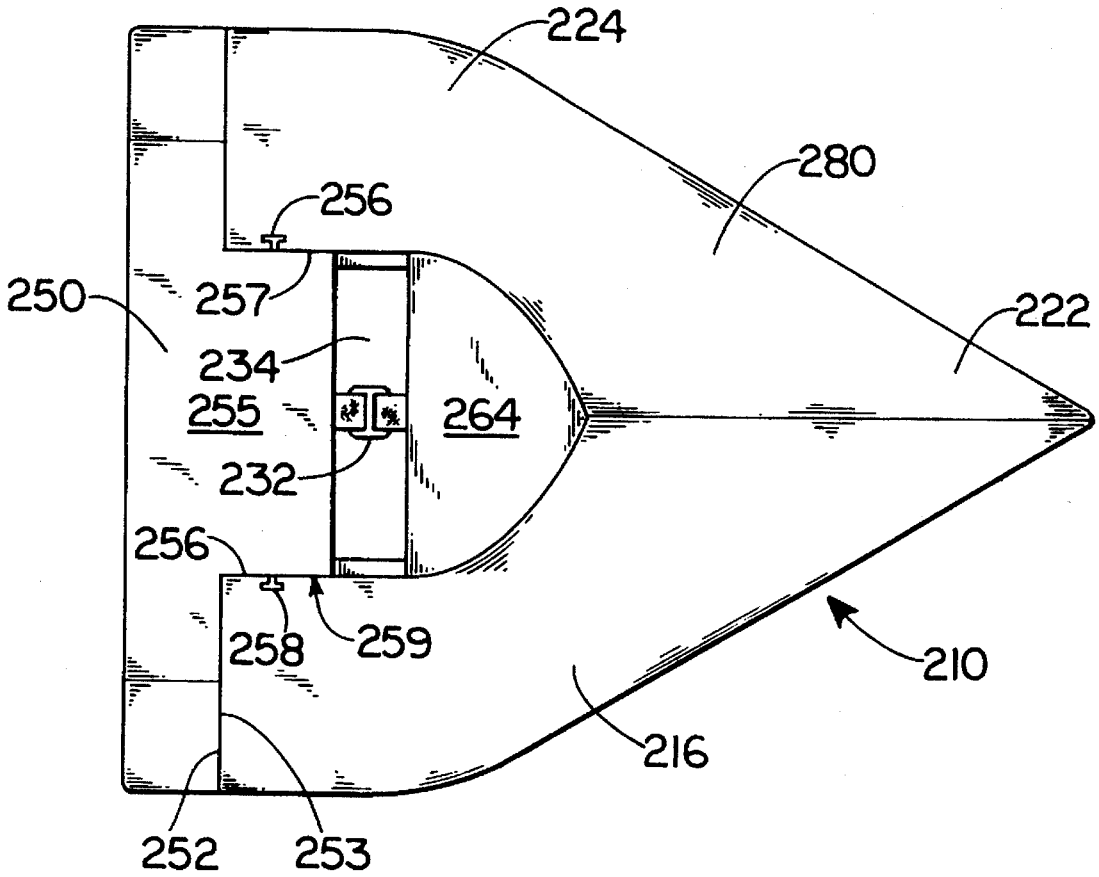
FIG. 5B is a bottom plan view of a third preferred embodiment of the invention, showing a removable T-shaped stern section.
Figure 5C:
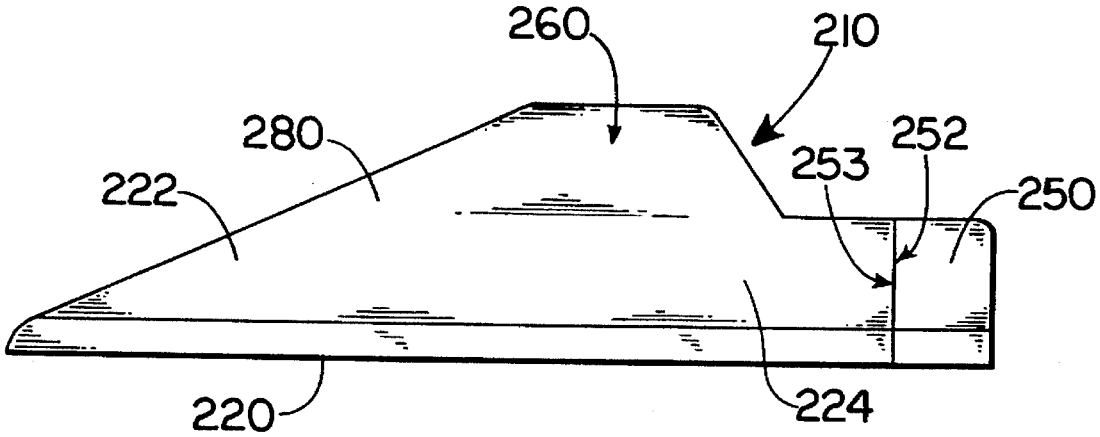
FIG. 5C is a side plan view of a third preferred embodiment of the invention, showing a removable T-shaped stern section.

With reference to FIGS. 5A and 5C, an opening 234 is defined through the hull 216. Below the upper surface 220 is a seating means for supporting the user, comprising a curved seat 230, a substantially vertical backrest 235, and side walls 237. A safety strap 232 is secured to the front edge of seat 230, and extends across opening 234 to a T-shaped stern adapter 250.

A plurality of attachment means 244 are situated about the perimeter of the upper surface 220 of hull 216. The attachment means 244 are used to secure interchangeable accessories to the flotation device 210, as shown in FIGS. 13 through 14.

The bottom of the flotation device is shown in FIGS. 5B and 5C. The underside 280 curves downward from upper surface 220, forming an apex at the distal end of the bow 222. Full keel 260 projects downward from lower surface 280. Opening 234 in hull 216 is situated between the substantially horizontal bottom surface 264 of the keel 260, and the stern adapter 250.

Figure 5D:
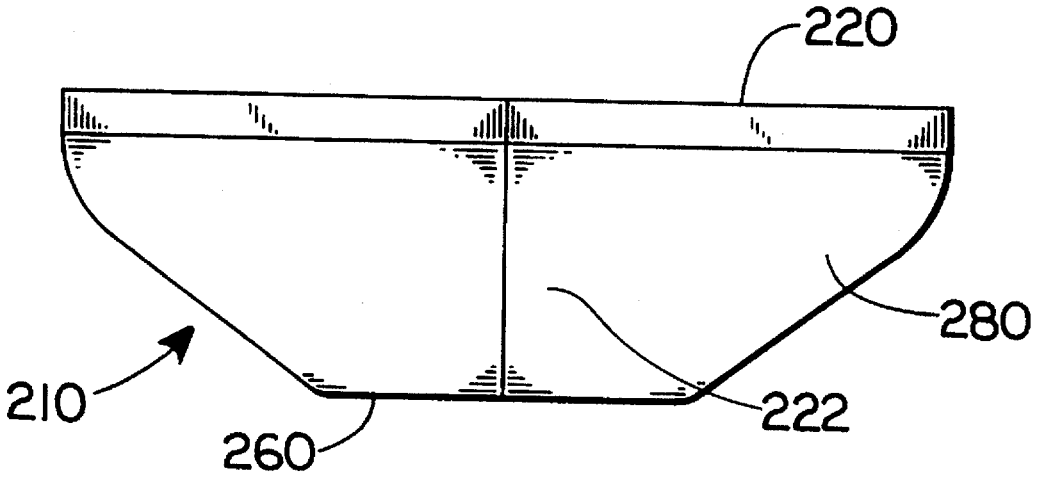
FIG. 5D is a front plan view of a third preferred embodiment of the invention, showing a removable T-shape stern section.
Figure 5E:
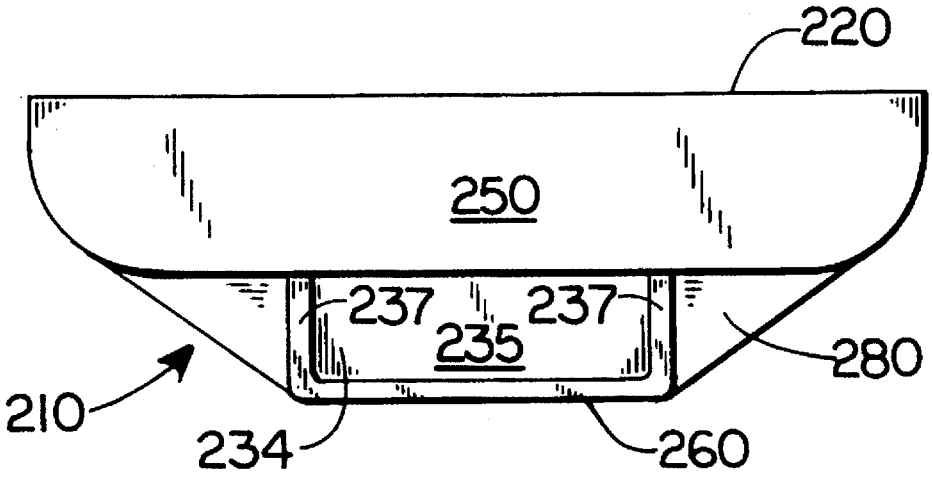
FIG. 5E is a back plan view of a third preferred embodiment of the invention.

FIG. 5D depicts the flotation device as viewed from the bow end. FIG. 5E depicts the flotation device as viewed from the stern end. Seat back 235 is shown as viewed through opening 234 in the hull 216.

Figure 5F:
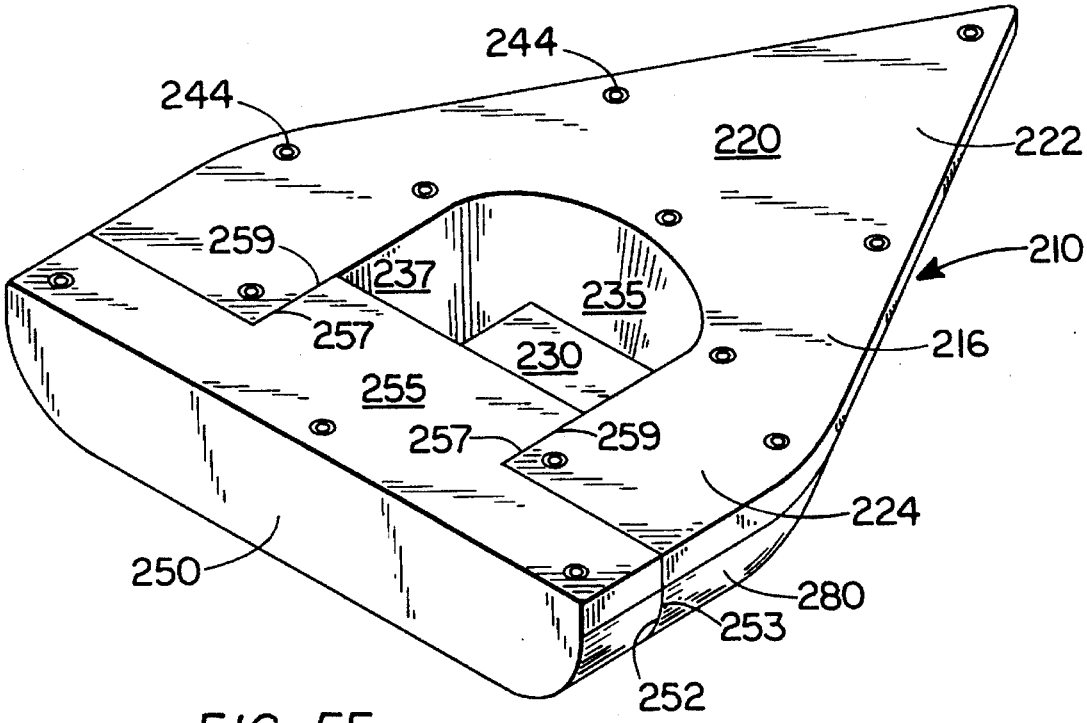
FIG. 5F is a perspective view of a third preferred embodiment of the invention, showing a removable T-shaped stern section.

FIG. 5F is a perspective view of the flotation device described in FIGS. 5A, 5B, 5C, 5D, and 5E.

Figure 6:
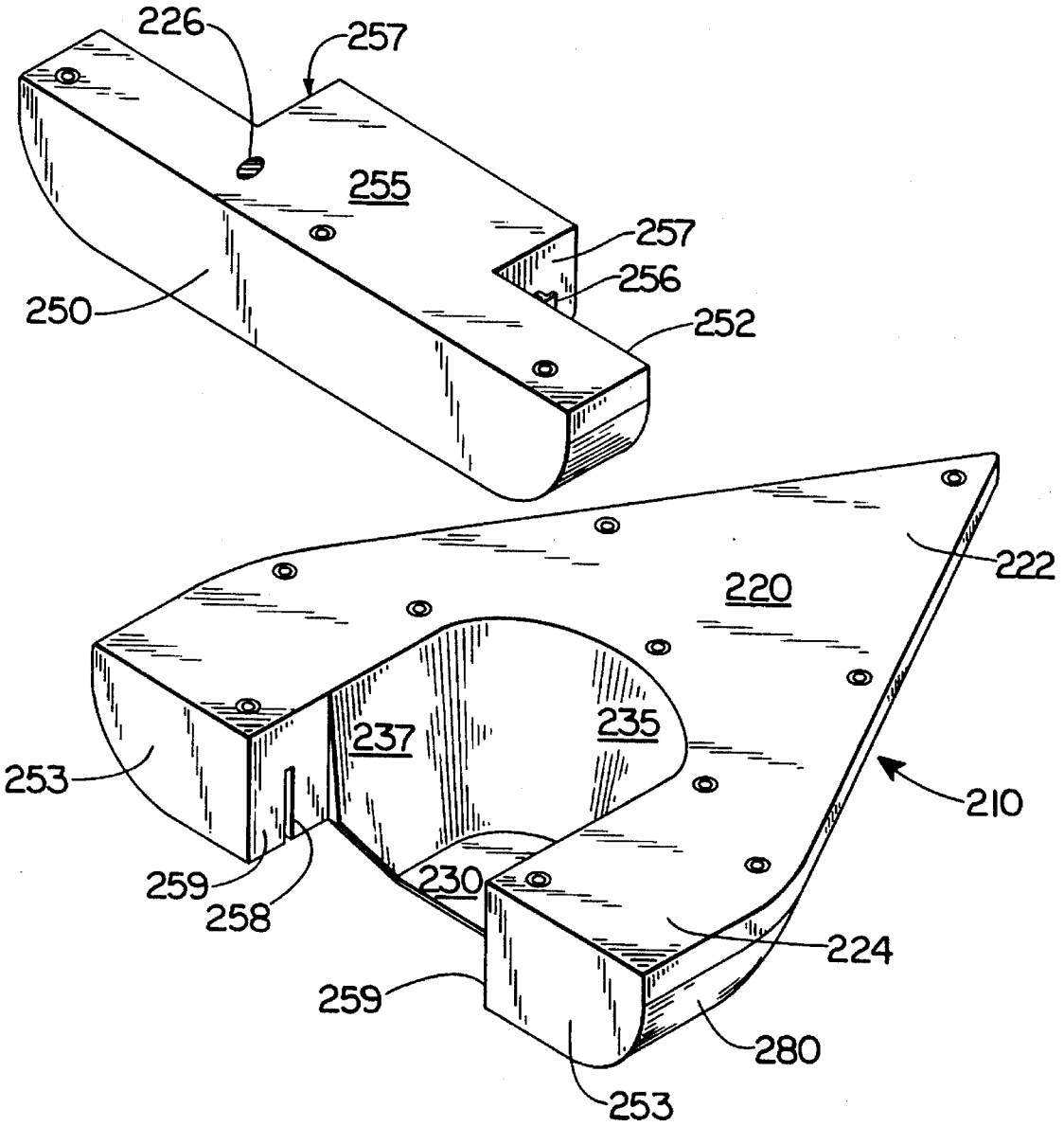
FIG. 6 is a perspective view of a third preferred embodiment of the invention, showing the T-shaped stern section removed from the body.

With specific reference to FIG. 6, the T-shaped stern adapter 250 has substantially vertical sides 257 and 252, which form a substantially 90° inside angle with each other. The flotation device 210 has substantially vertical walls 253 and 259, which form a substantially 90° outside angle with each other. The flotation device 210 slidably receives the T-shaped stern adapter 250 by sliding the T-shaped flanges 256 located on vertical sides 257 of stern adapter 250 into the T-shaped channels 258 located on inside walls 259 of the flotation device 210. Walls 259 are substantially perpendicular to upper surface 220 of flotation device 210, and complementary to the angle of sides 252 of stern adapter 250, such that when the stern adapter 250 is installed in the flotation device 210, side 257 is substantially adjacent to wall 259, and side 252 is adjacent to transom 253. Upper surface 255 of the stern adapter 250 is substantially horizontal.

An fourth preferred embodiment, is shown in FIGS. 7A, 7B, 7C, 7D, 7E, 7F and 8. This embodiment comprises of a flotation device 310 with a bow 322 and a stern 324, having a hull 316 with a substantially horizontal upper surface 320, a curved lower surface 380, and a keel 360 which extends downward from lower surface 380. In this embodiment, a substantially rectangular removable stern adapter 350 is mounted to the transom 353 at the stern 324. The stern adapter may be slidably mounted to the transom, as described above, or fixedly mounted thereto A receptacle 326 is provided on rectangular stern adapter 350 for receiving the handle of a fishing rod (not shown).

Figure 7A:
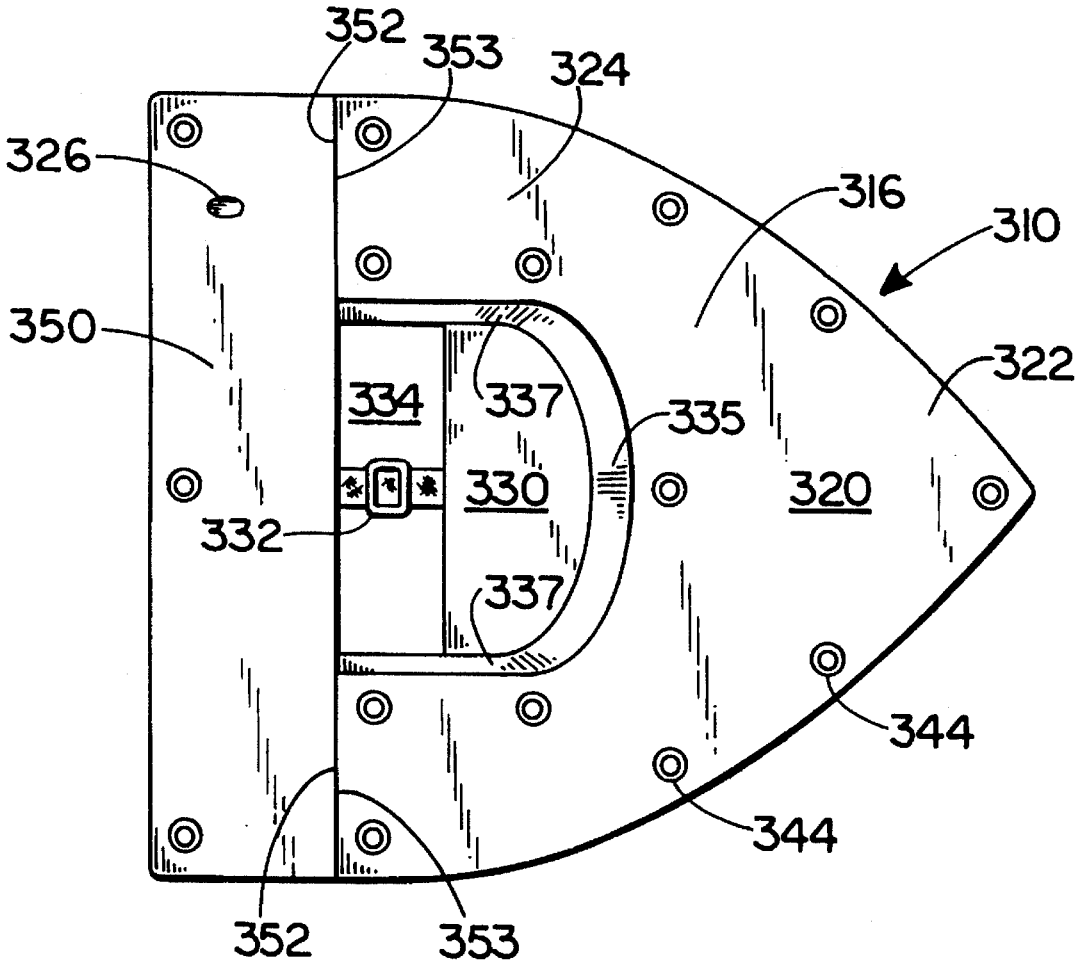
FIG. 7A is a top plan view of a fourth preferred embodiment of the invention, showing a removable rectangular stern.
Figure 7B:
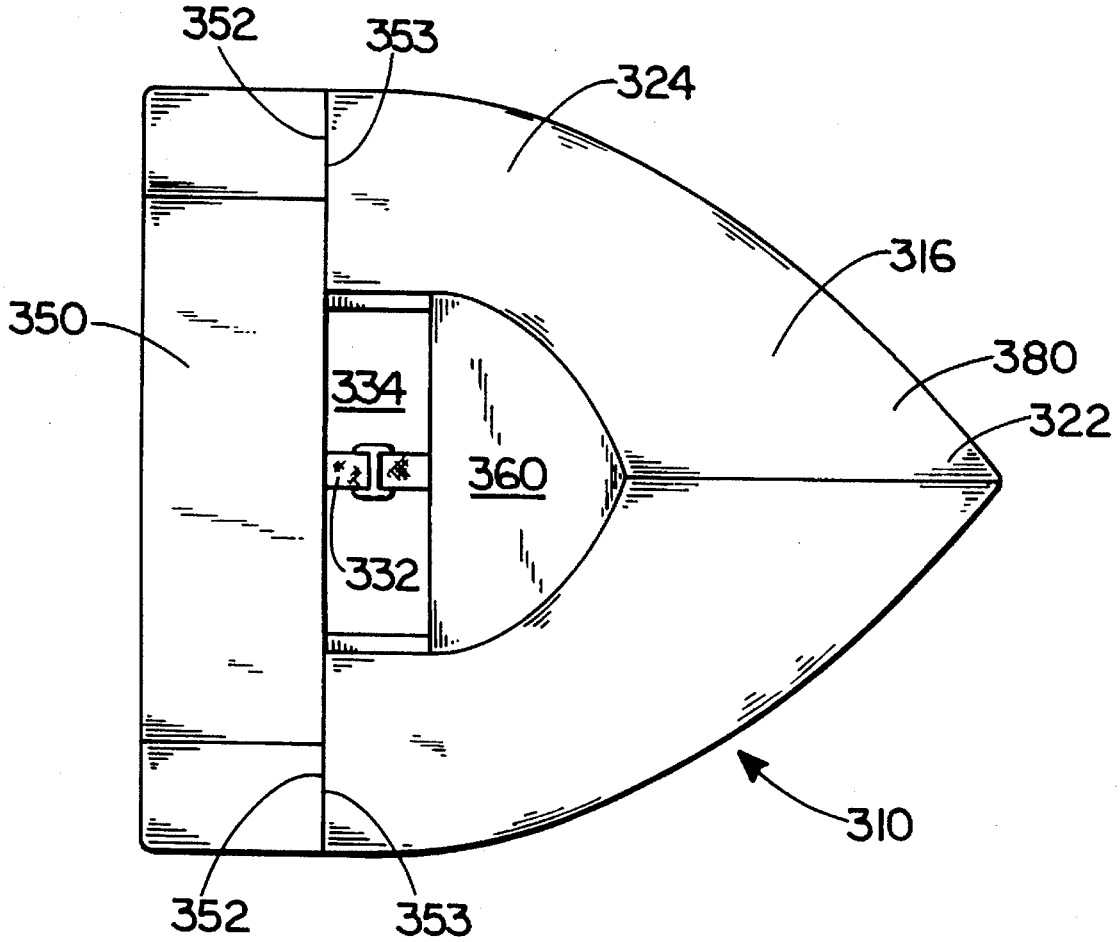
FIG. 7B is a bottom plan view of a fourth preferred embodiment of the invention, showing a removable retangular stern.
Figure 7C:
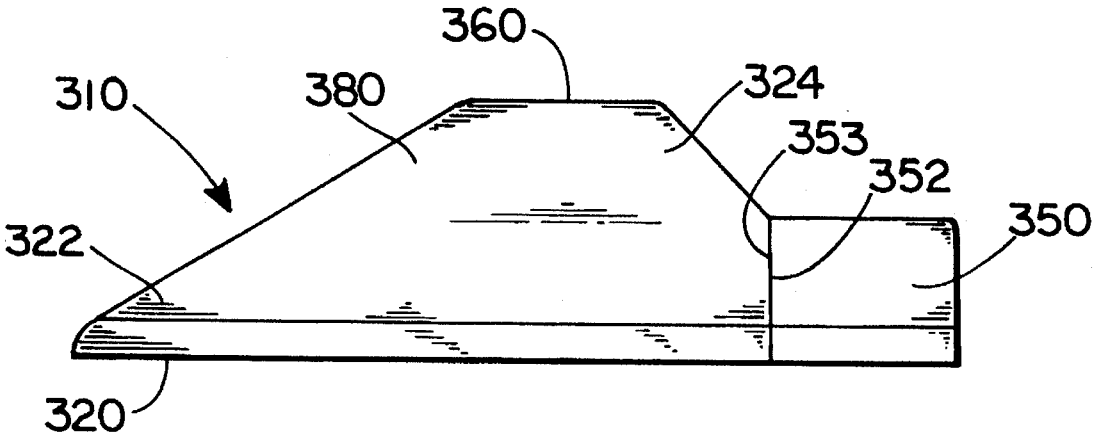
FIG. 7C is a side plan view of a fourth preferred embodiment of the invention, showing a removable retangular stern.

With reference to FIGS. 7A and 7C, an opening 334 is defined through the hull 316. Below the upper surface 320 is a seating means for supporting the user, comprising a curved seat 330, a substantially vertical backrest 335, and side walls 337. A safety strap 332 is secured to the front edge of seat 330, and extends across opening 334 to an elongated rectangular stern adapter 350.

A plurality of attachment means 344 are situated about the perimeter of the upper surface 320 of hull 316. The attachment means 344 are used to secure interchangeable accessories to the flotation device 310, as shown in FIGS. 13 through 14.

The bottom of the flotation device is shown in FIGS. 7B and 7C. The underside 380 curves downward from upper surface 320, forming an apex at the distal end of the bow 322. Full keel 360 projects downward from lower surface 380. Opening 334 in hull 316 is situated between the keel 360, and the stern adapter 350.

Figure 7D:
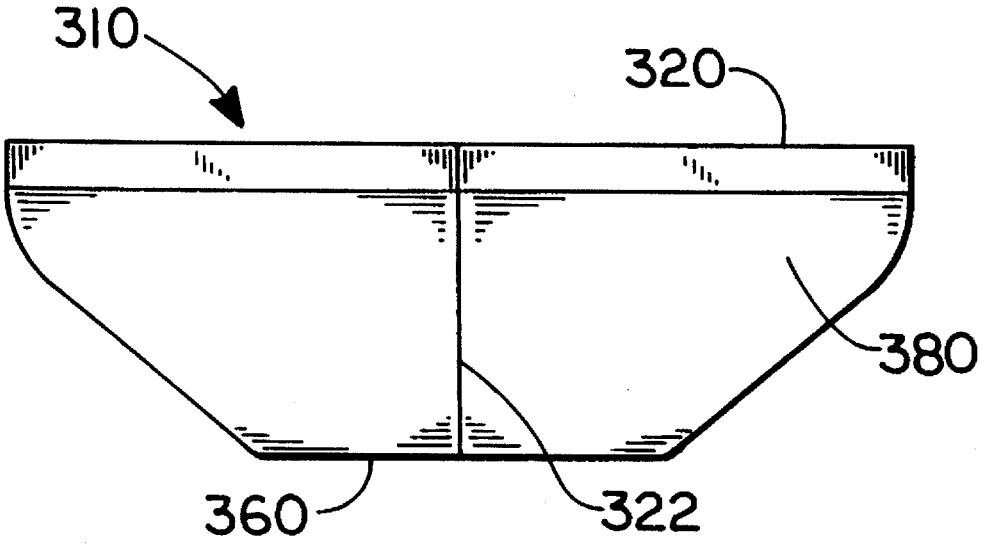
FIG. 7D is a front plan view of a fourth preferred embodiment of the invention, showing a removable retangular stern.
Figure 7E:
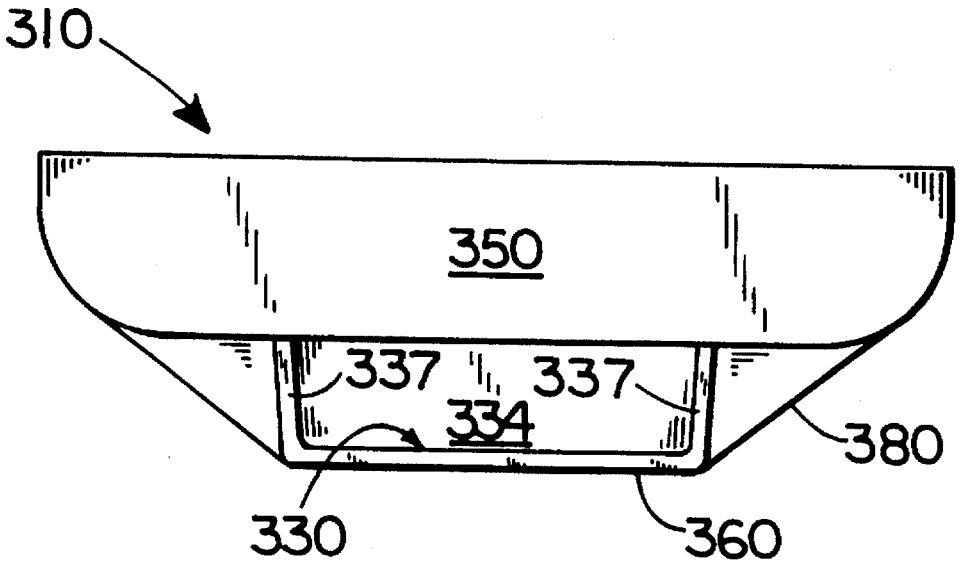
FIG. 7E is a back plan view of a fourth preferred embodiment of the invention.

FIG. 7D depicts the flotation device as viewed from the bow end. FIG. 7E depicts the flotation device as viewed from the stern end. Seat back 335 is shown as viewed through opening 334 in the hull 316.

Figure 7F:
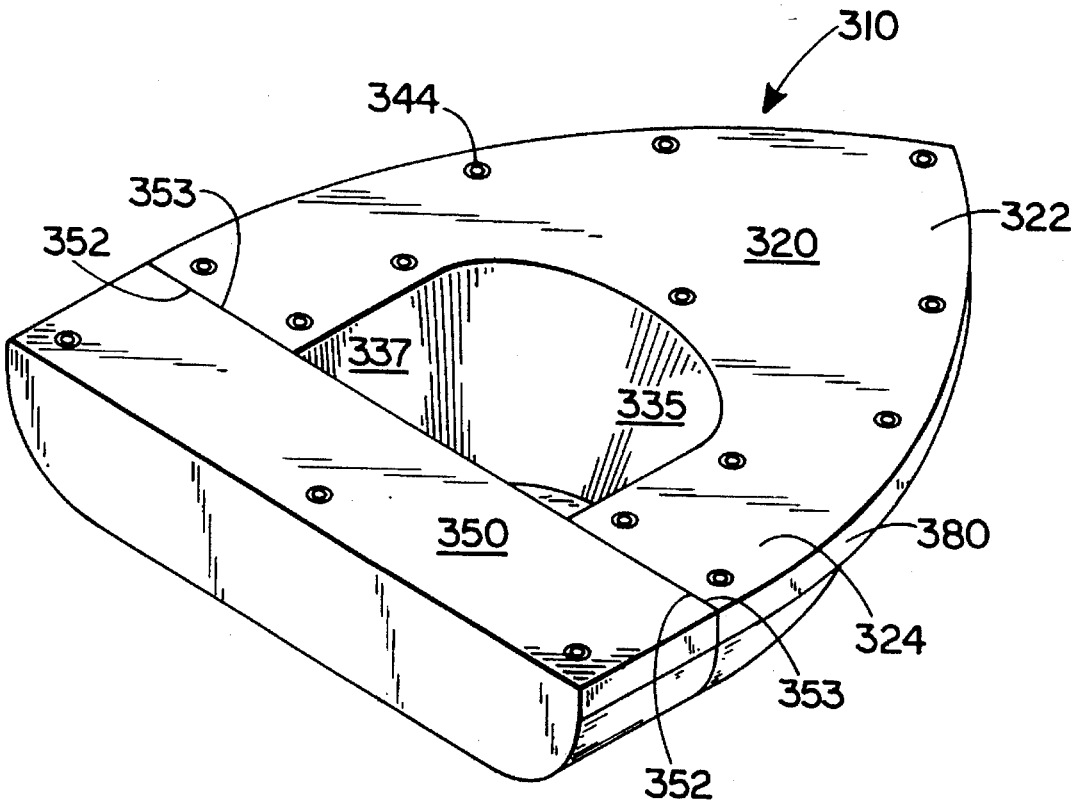
FIG. 7F is a perspective view of a fourth preferred embodiment of the invention, showing a removable retangular stern.

FIG. 7F is a perspective view of the flotation device described in FIGS. 7A, 7B, 7C, 7D, and 7E.

Figure 8:
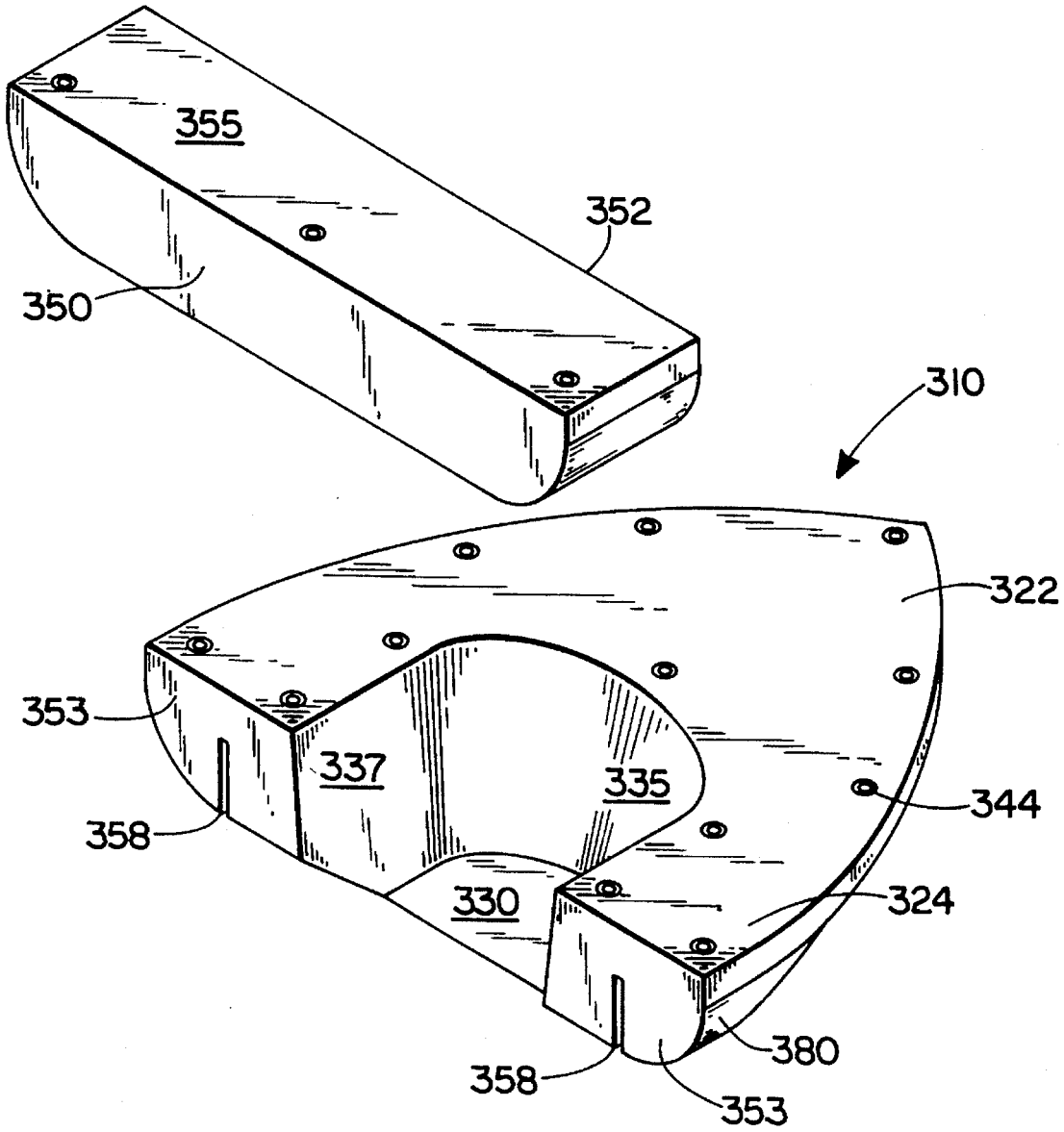
FIG. 8 is a perspective view of a fourth preferred embodiment of the invention, showing the rectangular stern removed from the body.

With specific reference to FIG. 8, the rectangular stern adapter 350 has an elongated side 352 which is substantially perpendicular to its upper surface 355. The flotation device 310 slidably receives the stern adapter 350 by sliding the T-shaped flanges (not shown on FIG. 8; See FIG. 4, number 156) located on elongated side 352 into the T-shaped channel 358 located on the transom 353 of the flotation device 310. The transom 353 is substantially perpendicular to upper surface 320 of flotation device 310, and complementary to the angle of elongated side 352 of stern adapter 350, such that when the stern adapter 350 is installed in the flotation device 310, elongated side 352 is substantially adjacent to transom 353. Upper surface 355 of the stern adapter 350 is substantially horizontal.

Figure 9A:
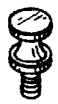
FIG. 9A is a perspective view of a cleat for attaching accessories to the flotation device.
Figure 9B:
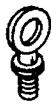
FIG. 9B is a perspective view of a threaded eye for attaching accessories to the flotation device.
Figure 9C:
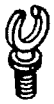
FIG. 9C is a perspective view of a flexible clip for attaching accessories to the flotation device.
Figure 9D:
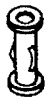
FIG. 9D is a perspective view of a spacer used in attaching accessories to the flotation device.

With reference to FIGS. 1F, 9A, 9B, 9C, and 9D, various attachments are provided for being interchangeably mounted on the flotation device 10 by way of the attachment means 44. In the preferred embodiment a plurality of threaded, vertical apertures 44 are defined in the upper surface 20 of the hull 16, although any conventional attachment means, such as an aperture or a bayonet mount would be sufficient. FIG. 9A shows a cleat, usually used as a tie off point for a line. FIG. 9B shows an eye or eyelet, usually used for threading a line therethrough. FIG. 9C shows a flexible clip or oar lock. FIG. 9D shows a spacer used for attaching accessories to the flotation device 10.

Figure 10:
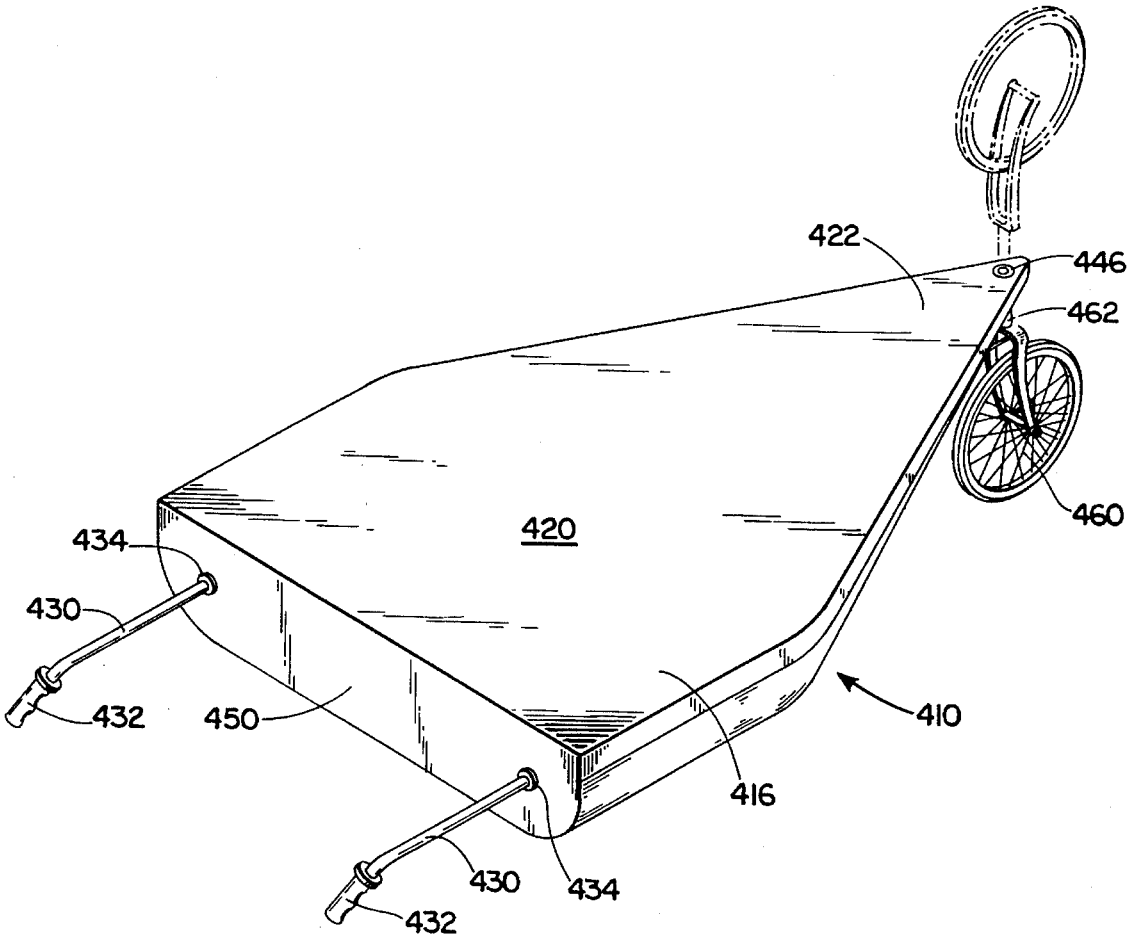
FIG. 10 is a perspective view of a preferred embodiment of a transportation means attached to the invention.
Figure 11A:
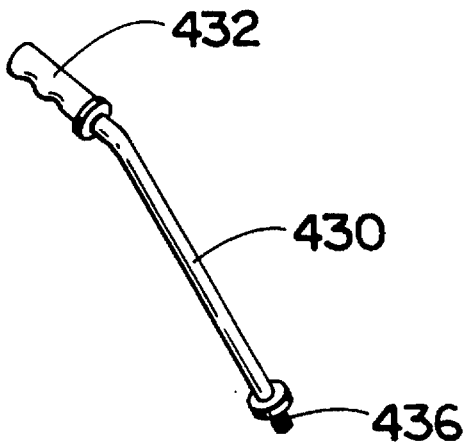
FIG. 11A is a perspective view of a handle of the transportation means.
Figure 11B:
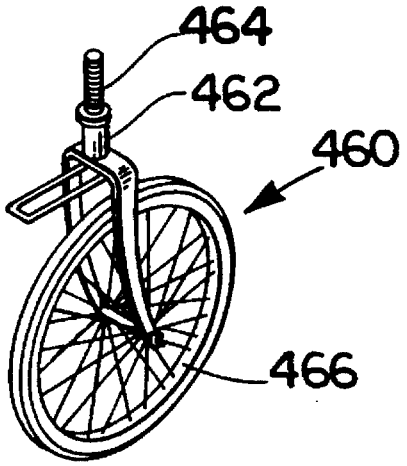
FIG. 11B is a perspective view of a wheel of the transportation means.

With reference to FIGS. 10, 11A and 11B, the floatation device 410 is provided with means for easily transporting it over the ground. In this preferred embodiment, a wheel structure 460 and a pair of handles 430 are provided along with a means for removably mounting the wheel 446 in the hull 416 proximate the bow 422 and a means for removably mounting the handles 434 on the transom 450.

Any conventional mounting means may be used for mounting the wheel structure 460 and the handles 430. Such means include an aperture, threaded aperture (or screw mount), or a bayonet mount.

In this embodiment, a threaded, vertical aperture 446 is defined through the hull 416, so that the wheel structure 460 may be mounted to the upper surface 420 or the lower surface 480 of the flotation device 410. The wheel 466 is mounted on a Y-shaped arm 462 the wheel 466 rotatably mounted between the arms of the Y-shaped arm 462 and the leg 464 of the Y-shaped arm 462 being threaded to be removably received in the threaded aperture 446.

Also in embodiment shown in these figures, a pair of threaded, horizontal, spaced apertures 434 are provided in the transom 450. One end of each handle 436 is received in a respective aperture 434, the other end of each handle 430 having a molded handgrip 432 thereon for providing easier handling.

Figure 12:
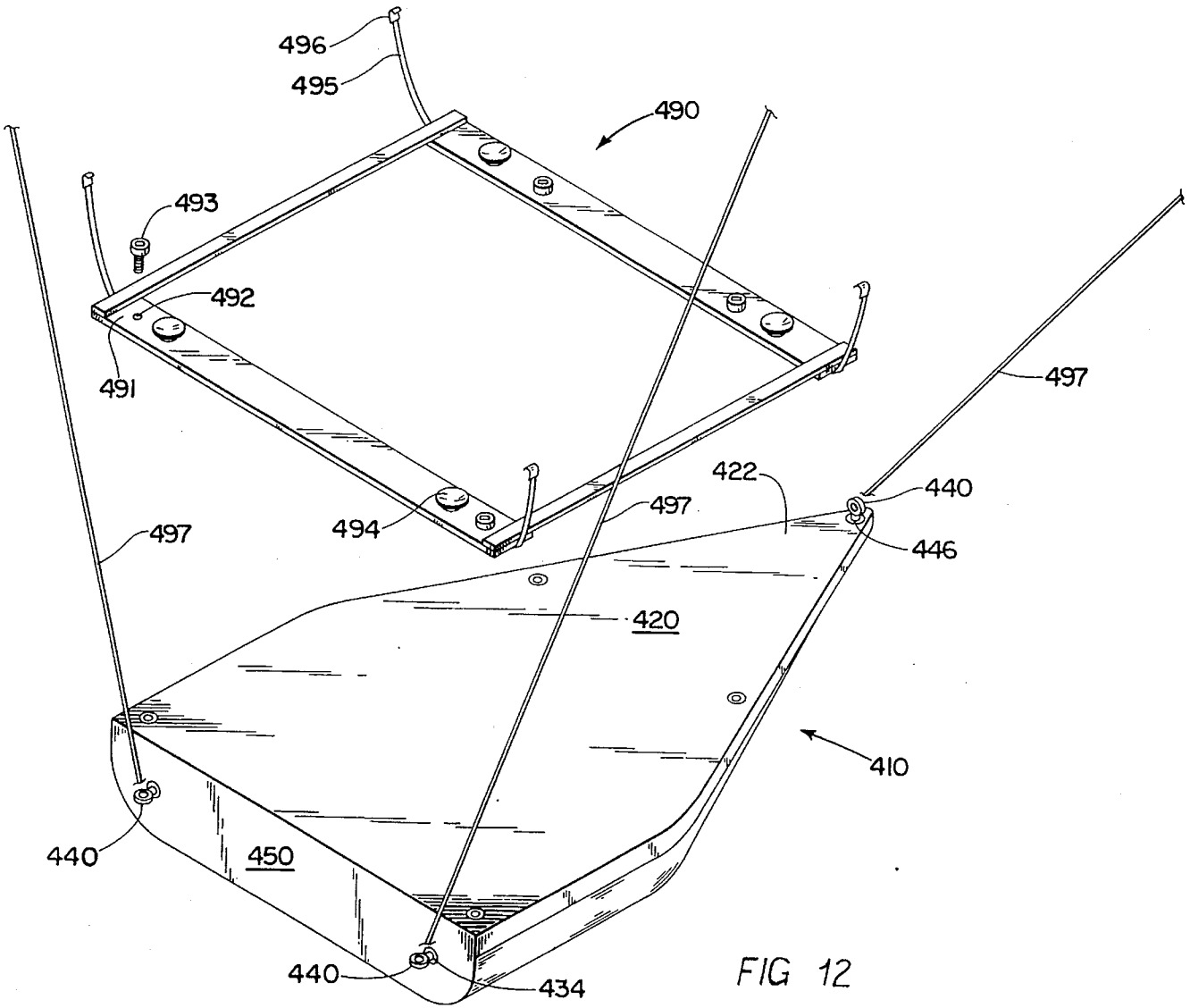
FIG. 12 is a perspective view of a preferred embodiment of car top carrier for the flotation device.
Figure 13A:
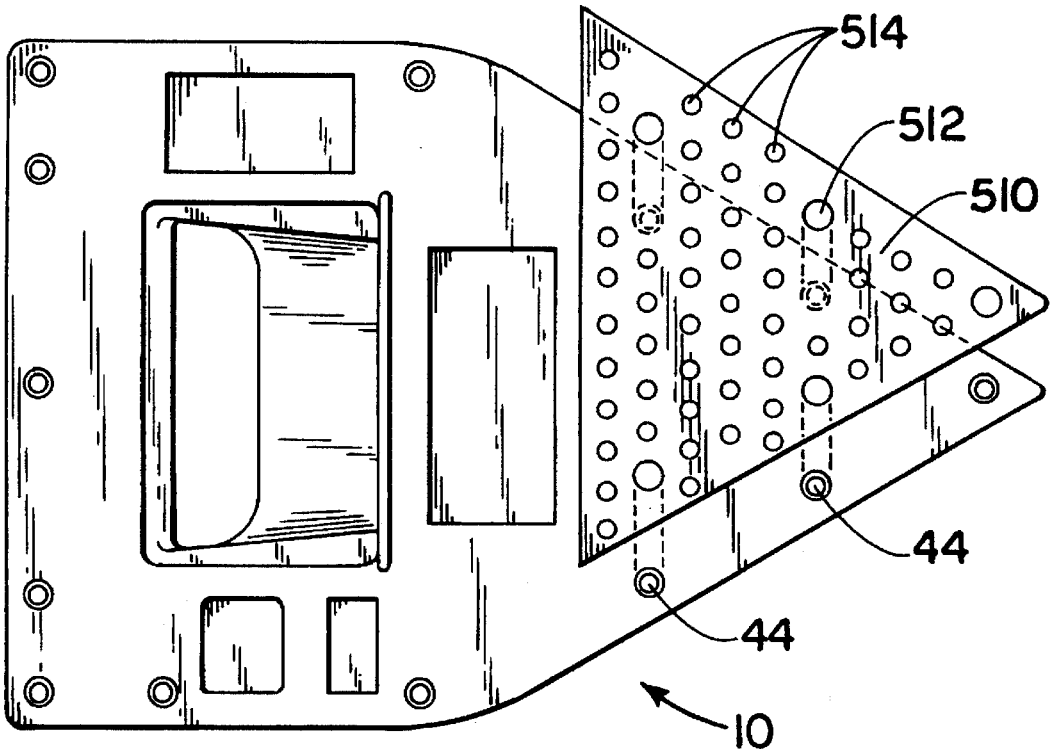
FIG. 13A is a top plan view of a preferred embodiment of a duck blind attachment plate.
Figure 13B:
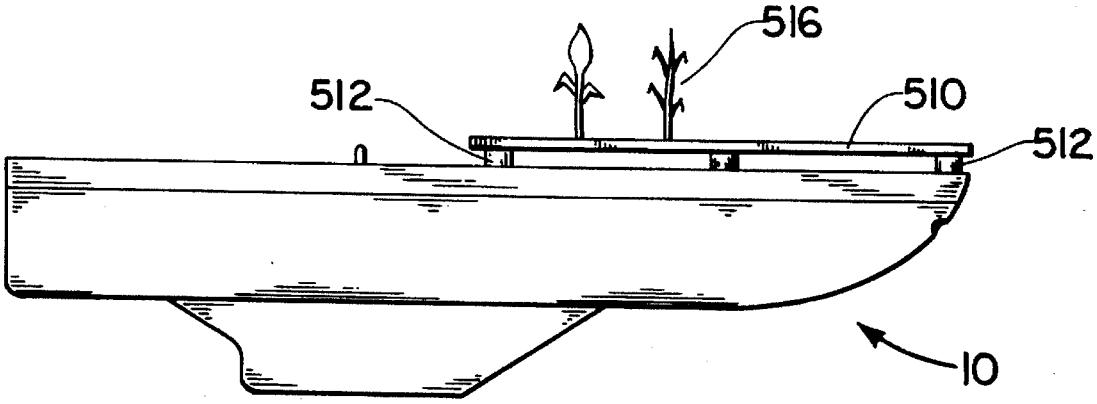
FIG. 13B is a side plan view of a preferred embodiment of a duck blind attachment plate.
Figure 13C:
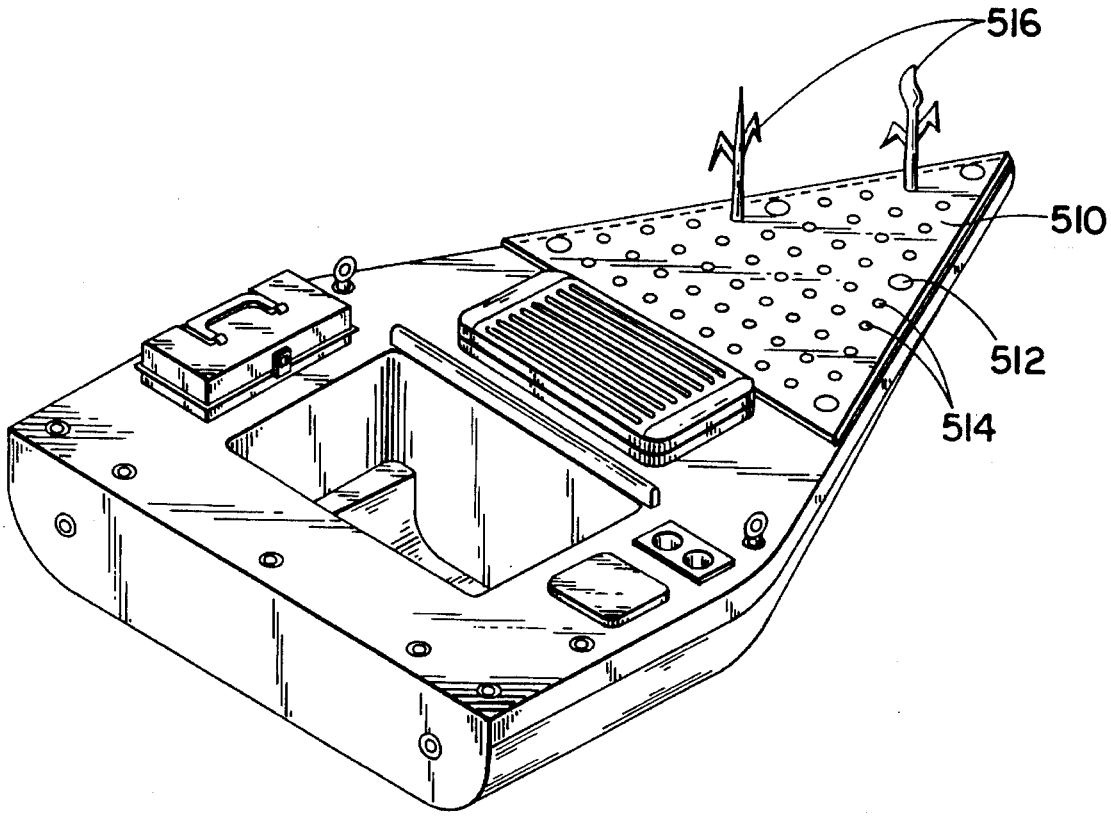
FIG. 13C is a perspective view of a preferred embodiment of a duck blind attachment plate.
Figure 13D:
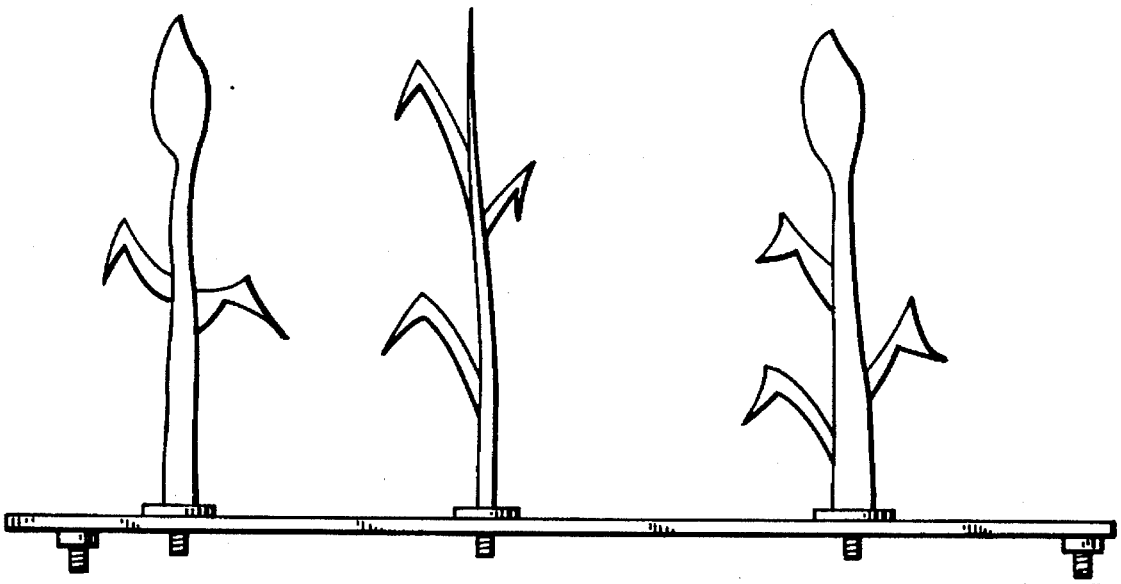
FIG. 13D is a side plan view of the duck blind attachment plate with the plant shaped attachments mounted thereon.

With reference to FIG. 12, a car top carrier 490, can be provided, to permit the flotation device 410 to be mounted, upper surface 420 down, on the roof of a standard automobile and the like.

In its preferred embodiment, the car top carrier 490 comprises a substantially rectangular frame 491. The frame 491 has a set of holes, preferably threaded, spaced about it for receiving threaded mounting bolts 493 therethrough. The ends of the mounting bolts 493 are in turn received in the attachment means 44 of the flotation device 410 for mounting the frame 491 to the upper surface 420 of the device 410.

The carrier 490 further includes a set of pads, cushions or preferably suction cups 490 on the side of the frame 491 away from the flotation device 410 for being placed in operative contact with the roof of the automobile. Additionally, straps 495 having hooks 496 at there ends may be provided on the frame 491 for attaching to the rain gutters of the automobile. These straps 495 are preferably adjustable. Additional lines 497 may be attached at the bow 422 by way of an eyelet 440 received in the threaded vertical aperture 446, and at the stern 424 by way of eyelets 440 received in the threaded horizontal apertures 434 in the transom 450 to further secure the flotation device resepctively to the front and rear bumpers of the automobile.

With reference to FIGS. 13A, 13B, 13C and 13D, an attachment plate 510 is provided for receiving plant shaped attachments 520 to transform the flotation device 10 into a floating blind. The attachment plate 510 is disposed over the bow 22 of the flotation device 10, mounted thereto by way of the attachment means 44. In the pictured embodiment, a set of threaded posts 512 is provided on the attachment plate 510 for being threadly received by the attachment means 44.

The attachment plate 510 is provided with a plurality of apertures for mounting the plant shaped attachments 520 thereto. Any conventional method of mounting may be used, such as a simple aperture or bayonet type mounting, although a threaded mounting 514 is preferred. The plant shaped attachments 520 are threaded 530 at their lower end to be received in the threaded apertures 514. The plant shaped attachments 520 may be arranged on the attachment plate 510 to camouflage the flotation device 10, creating a blind for the sportsman.

Figure 14A:
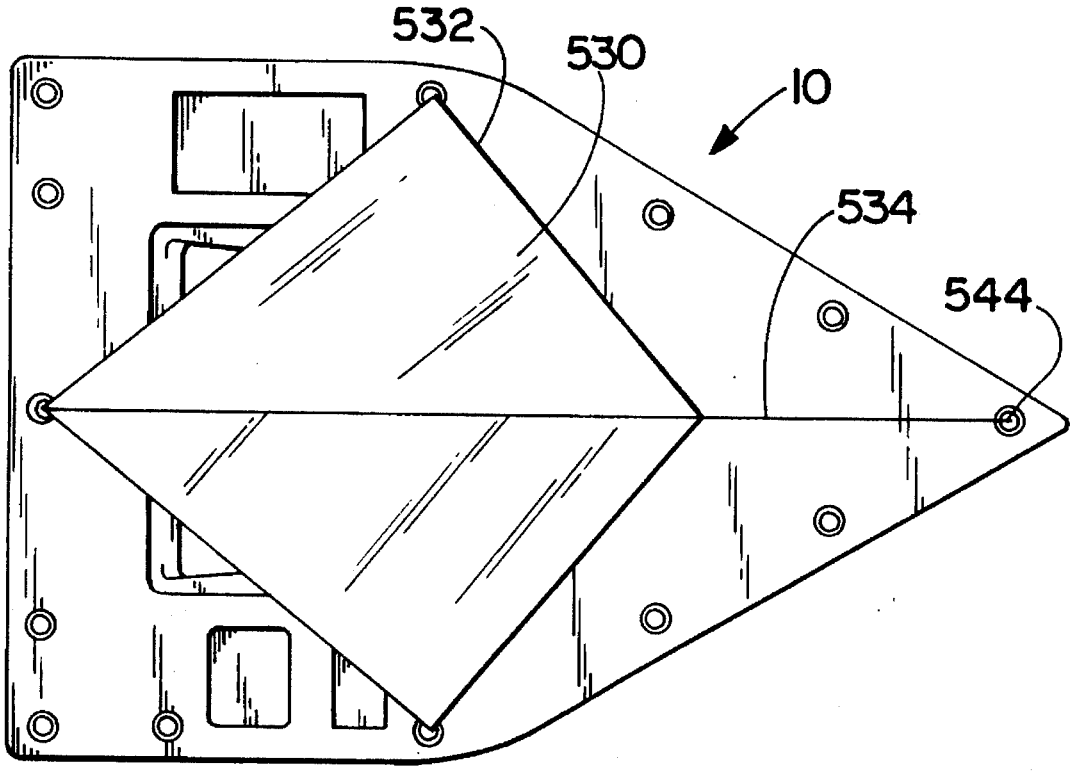
FIG. 14A is a top plan view of a preferred embodiment of a weather shade attachment.
Figure 14B:
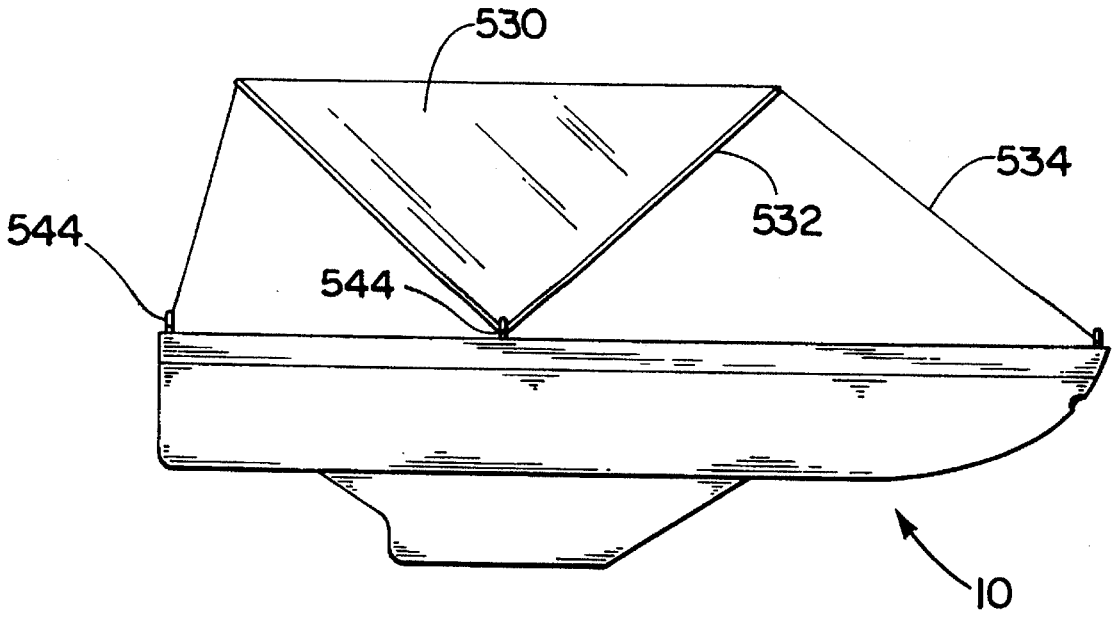
FIG. 14B is a side plan view of a preferred embodiment of a weather shade attachment.
Figure 14C:
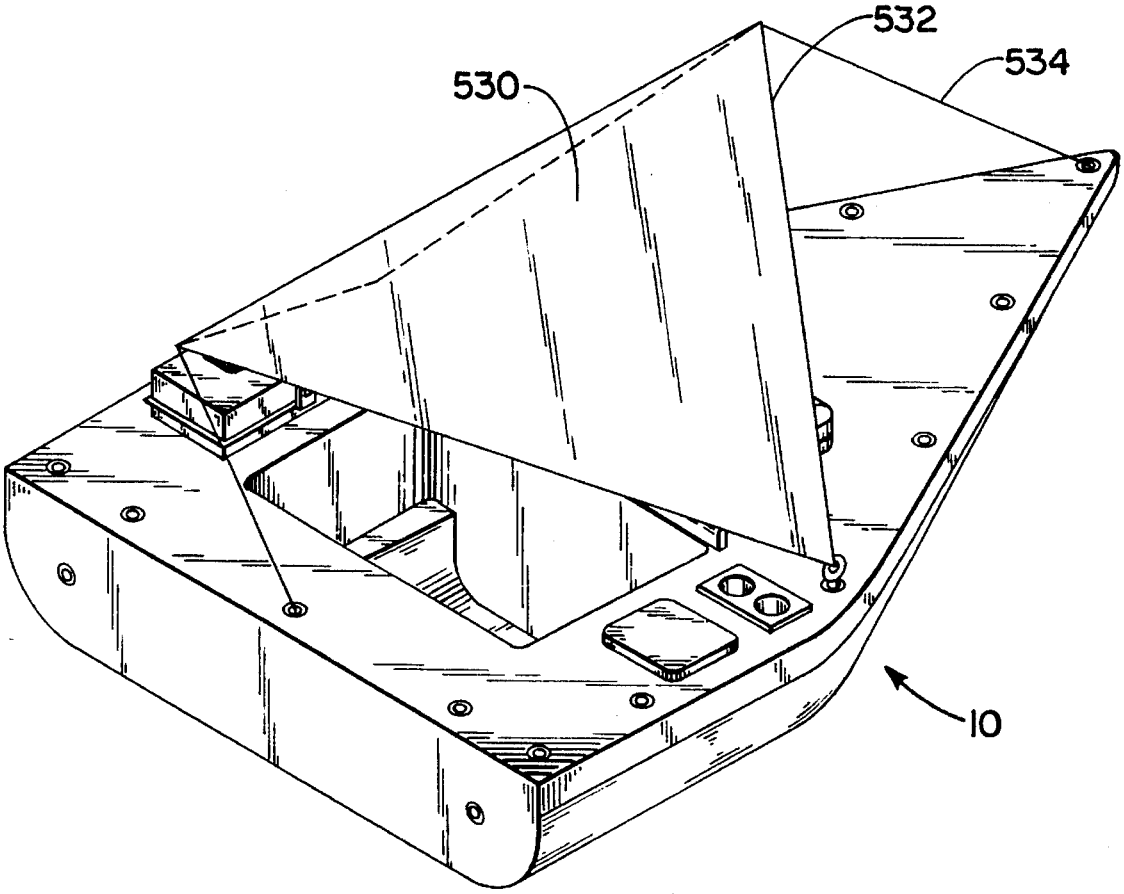
FIG. 14C is a perspective view of a preferred embodiment of a weather shade attachment.

With reference to FIGS. 14A, 14B and 14C, a weather shade may be provided for keeping the sportsman dry in wet weather, or shaded when sunny.

In the preferred embodiment, the weather shade consists of a tarp 530 perferrably made of a waterproof canvas, which may be rolled up or folded when not in use. Each of the edges of the tarp 530 is rolled over and sewn together to form a sleeve. An elongated member 532 is provided for each of the sleeve, the member 532 received in the sleeve to provide support to the tarp 530. The elongated members 532 may be rigid poles, however a resilient plastic rod or spline is preferred. A first end of each of the elongated members 532 is mounted to the flotation device 10 by way of the attachment means 544. Lines 534 may be used to attach the ends where adjacent elongated members 532 meet to the flotation device 10 also by way of the attachment means 544. Lights (not shown) may be mounted on the flotation device 10 by way of the attachment means 544 to permit safe use and navigation at night.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

I claim:

1. A flotation device capable of being propelled by at least one leg of at least one user, the device comprising;

a hull having a bow, a stern, a full keel, and an opening defined through the hull for receiving the leg of the user therethrough, said full keel including a curved side surface, a lower surface adjacent to the curved side surface, a substantially horizontal bottom surface and a cavity formed between the curved side surface, and said cavity providing a seating space for seating the user therein.

2. The personal flotation device of claim 1 wherein the opening is located in the keel portion of the hull proximate the stern.

3. The personal flotation device of claim 1 wherein the full keel defines a cavity therein; and the seating space is located within the cavity of the full keel providing for the user to act as a ballast within the full keel.

4. A personal flotation device for being propelled and steered by a pair of legs of a user, the device comprising:

a single hull, the hull having a bow, a stern, and a full keel, the full keel defining means for seating therein, the full keel further defining an opening therethrough, proximate the stern, for receiving the legs of the user, said full keel including a curved side surface, a lower surface adjacent to the curved side surface, a substantially horizontal bottom surface and a cavity formed between the curved side surface, and said cavity providing a seating space for seating the user therein.

5. The personal flotation device of claim 1 further comprising:

a transom; and means for modifying the shape of the stern.

6. The personal flotation device of claim 5 wherein the stern modifying means comprises:

at least one stern adapter; and means on the transom for interchangeably mounting the stern adapter thereto.

7. The personal flotation device of claim 6 wherein the stern adapter mounting means comprises:

a pair of vertical guide slots on the transom of the hull; and a pair of vertical guide members on the stern adapter, the guide members slidingly received within the guide slots of the hull.

8. A modular personal flotation device comprising:

a hull, the hull having a bow, a stern, a transom, and a full keel, the full keel defining a cavity therein, an opening defined in the hull proximate the stern for receiving the legs of the user therethrough, and said full keel including a curved side surface, a lower surface adjacent to the curved side surface, a substantially horizontal bottom surface and a cavity formed between the curved side surface, and said cavity providing a seating space for seating the user therein; means within the cavity of the full keel for supporting a user therein;

means for modifying the shape of the stern; and a plurality of means on the hull for interchangeably mounting an attachment thereto.

9. The device of claim 8 wherein the stern shape modifying means comprises:

at least one stern adapter; and means on the transom for interchangeably mounting the stern adapter thereto.

10. The device of claim 8 wherein the user supporting means comprises:

a substantially horizontal seat formed with the full keel; and a backrest formed integrally with the full keel at a non-acute angle to the bottom surface of the full keel.

11. A modular personal flotation device comprising:

a hull, the hull having a bow, a stern, a transom, and a full keel said full keel including a curved side surface, a lower surface adjacent to the curved side surface, a substantially horizontal bottom surface and a cavity formed between the curved side surface, and said cavity providing a seating space for seating the user therein, an opening defined in the hull proximate the stern for receiving the legs of the user therethrough;

means within the cavity of the full keel for supporting a user therein;

means for modifying the working surfaces of the flotation device; and a plurality of means on the hull for interchangeably mounting an attachment thereto.

12. The device of claim 11 wherein the working surfaces modifying means comprises:

at least one stern adapter; and means on the transom for interchangeably mounting the stern adapter thereto.

13. The device of claim 11 wherein the user supporting means comprises:

a back rest formed integrally with the full keel at a non-acute angle to the bottom surface of the full keel.

14. A modular personal flotation device comprising:

a hull, the hull having a bow, a stern, a transom, an upper surface and a full keel, said full keel including a curved side surface, a lower surface adjacent to the curved side surface, a substantially horizontal bottom surface and a cavity formed between the curved side surface, and said cavity providing a seating space for seating the user therein, an opening defined in the hull proximate the stern for receiving the legs of the user therethrough;

means within the cavity of the full keel for supporting a user therein;

means for modifying the shape of the stern;

a plurality of means on the hull for interchangeably mounting an attachment thereto;

at least one wheel rotatably and removably mounted to the hull;

an attachment plate, having a plurality of apertures therethrough, mounted to the upper surface of the flotation device;

a plurality of plant shaped attachments removably received in one of the respective apertures of the attachment plate;

a weather shade removably mounted to the upper surface of the hull; and a car top carrier removably mountable to the upper surface of the hull and removably mountable to a top of a car.

* * * * *